US011732722B2

(12) United States Patent
Manabe

(10) Patent No.: US 11,732,722 B2
(45) Date of Patent: Aug. 22, 2023

(54) VACUUM PUMP

(71) Applicant: SHIMADZU CORPORATION, Kyoto (JP)

(72) Inventor: Masashi Manabe, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 17/947,098

(22) Filed: Sep. 17, 2022

(65) Prior Publication Data

US 2023/0096958 A1 Mar. 30, 2023

(30) Foreign Application Priority Data

Sep. 29, 2021 (JP) ..... 2021-159080
Jan. 28, 2022 (JP) ..... 2022-012172

(51) Int. Cl.
*F04D 19/04* (2006.01)
*F04D 29/00* (2006.01)

(52) U.S. Cl.
CPC ..... *F04D 19/042* (2013.01); *F04D 29/002* (2013.01); *F05D 2210/12* (2013.01)

(58) Field of Classification Search
CPC ..... F04D 19/04; F04D 19/042
See application file for complete search history.

(56) References Cited

U.S. PATENT DOCUMENTS 6,866,472 B2 * 3/2005 Okudera ..... F04D 27/0292 415/143
11,428,237 B2 * 8/2022 Kabasawa ..... F04D 13/06

FOREIGN PATENT DOCUMENTS

DE 19756837 A1 * 7/1999 ..... F04D 19/044
JP 2021-102926 A 7/2021
WO WO-2021172144 A1 * 9/2021 ..... F04D 29/5806

* cited by examiner

*Primary Examiner* — David E Sosnowski
*Assistant Examiner* — Jackson N Gillenwaters
(74) *Attorney, Agent, or Firm* — Renner, Otto, Boisselle & Sklar, LLP

(57) ABSTRACT

A vacuum pump includes a housing, a rotor cylindrical portion, and a stator cylindrical portion. The housing has an inlet port for sucking gas and an outlet port for discharging the sucked gas. The rotor cylindrical portion is housed in the housing. The stator cylindrical portion is housed in the housing, and is arranged to face the rotor cylindrical portion. A screw groove is formed on one of opposing surfaces of the stator cylindrical portion and the rotor cylindrical portion. The groove depth D of the screw groove is smaller at an end on an exhaust side than at an end on a suction side. The decrement of the groove depth D is greater on the suction side than on the exhaust side.

8 Claims, 26 Drawing Sheets

VACUUM PUMP

CROSS-REFERENCE TO RELATED APPLICATIONS

This application claims priority to Japanese Patent Application No. 2021-159080 filed on Sep. 29, 2021 and Japanese Patent Application No. 2022-012172 filed on Jan. 28, 2022 before the Japanese Patent Office, the contents of which are incorporated herein by reference in their entirety.

BACKGROUND OF THE INVENTION

Filed of the Invention

The present invention relates to a vacuum pump.

Description of the Related Art

In the field of, e.g., a semiconductor manufacturing device, a vacuum pump has been used for bringing atmosphere into a high-vacuum state (see, e.g., JP-A-2021-102926).

In the vacuum pump described in JP-A-2021-102926, a turbine pump portion arranged on a suction port side and a drag pump portion arranged on an exhaust port side are provided.

A performance index upon pumping by a turbo-molecular pump is a suction port pressure with respect to a gas flow rate, and the suction port pressure increases as the gas flow rate increases.

Another performance index upon pumping by the turbo-molecular pump is back pressure properties. The back pressure properties indicate a measurement result of a change in the suction port pressure when the pressure of an exhaust port of the turbo-molecular pump increases in a state in which a certain amount of gas has been injected. The number of gas molecules flowing back to the suction side from the exhaust side increases as the exhaust port pressure increases, and therefore, the suction port side pressure increases. The number of flowing-back gas molecules can be decreased as the exhaust port pressure at which the suction port pressure starts increasing increases. This indicates favorable back pressure properties.

SUMMARY OF THE INVENTION

In recent years, the flow rate of gas in the turbo-molecular pump has been increasing, and there has been a demand for reduction in the inlet port pressure upon pumping of a great amount of gas.

For reducing the suction port pressure upon pumping of a great amount of gas, it is effective to design the drag pump portion such that the conductance thereof is great. However, in the case of this design, not only gas molecules moving from the inlet port to the outlet port increase, but also gas molecules flowing back to the inlet port from the outlet port increase. For this reason, the back pressure properties are degraded.

The present invention is intended to provide a vacuum pump capable of pumping a great amount of gas with improved back pressure properties.

A vacuum pump according to one aspect of the present invention includes a housing, a rotor cylindrical portion, and a stator cylindrical portion. The housing has an inlet port for sucking gas and an outlet port for discharging the sucked gas. The rotor cylindrical portion is housed in the housing.

The stator cylindrical portion is housed in the housing, and is arranged to face the rotor cylindrical portion. A screw groove is formed on one of opposing surfaces of the stator cylindrical portion and the rotor cylindrical portion. The groove depth of the screw groove is smaller at an end on an exhaust side than at an end on a suction side. The decrement of the groove depth is greater on the suction side than on the exhaust side.

According to the above-described aspect of the present invention, the vacuum pump capable of pumping a great amount of gas with improved back pressure properties can be provided.

EMBODIMENTS FOR CARRYING OUT THE INVENTION

Hereinafter, vacuum pumps of embodiments of the present invention will be described with reference to the drawings.

First Embodiment

Hereinafter, a vacuum pump of a first embodiment will be described.

(Outline of Vacuum Pump 1)

Figure 1:
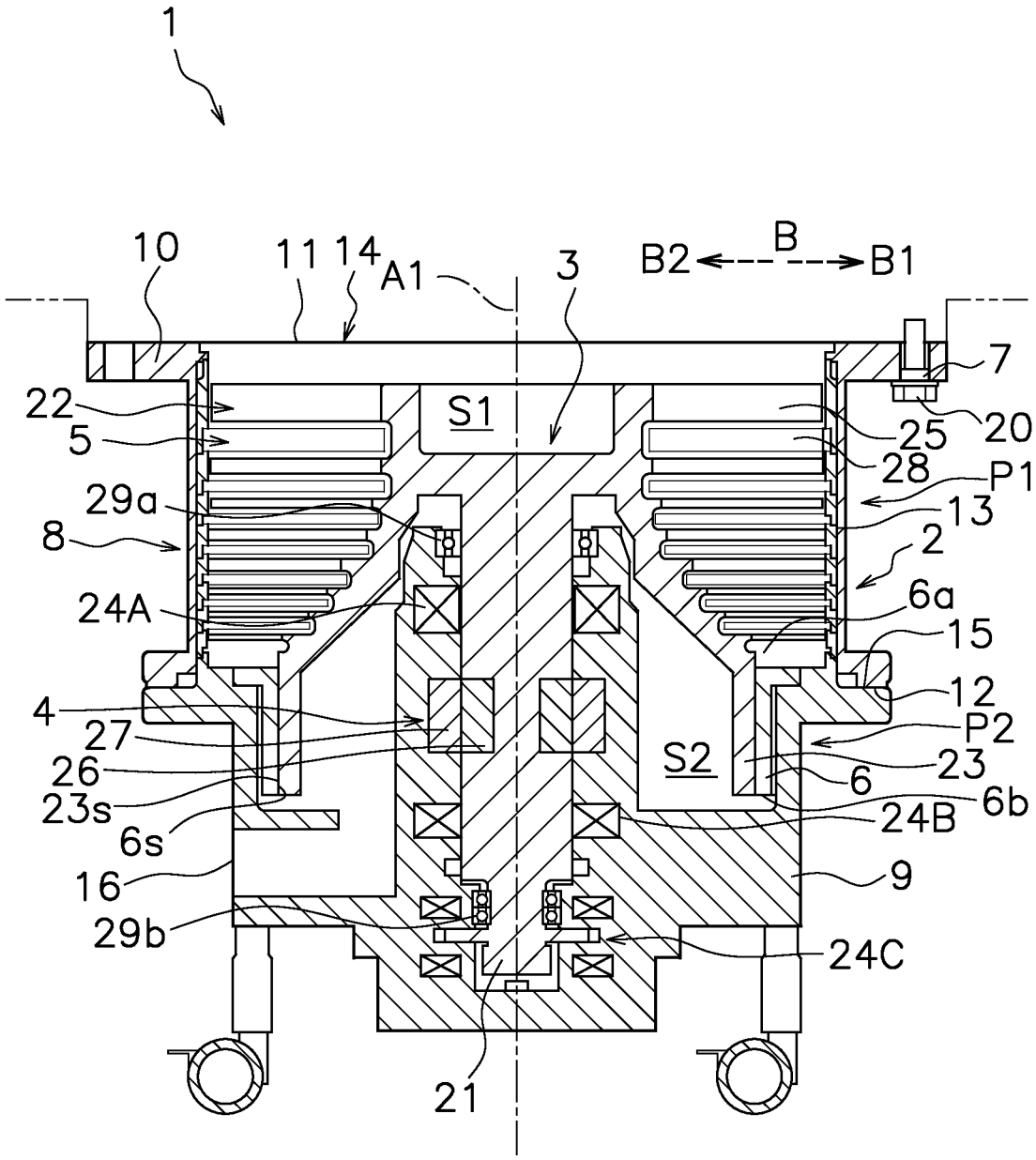
FIG. 1 is an external view of a vacuum pump according to a first embodiment.

FIG. 1 is a sectional view of a vacuum pump 1 according to the embodiment.

The vacuum pump 1 includes a turbine portion P1 and a drag pump portion P2. The turbine portion P1 forms a turbo-molecular pump. The drag pump portion P2 forms a screw groove pump. The vacuum pump 1 is connected to a pumping target device including a pumping target space. Gas from the pumping target space is pumped by the turbine portion P1, and thereafter, is pumped by the drag pump portion P2. Then, the gas is pumped to the outside of the vacuum pump 1.

As shown in FIG. 1, the vacuum pump 1 has a housing 2 (one example of a housing), a rotor 3, a motor 4, multiple stator blade units 5, and a stator cylindrical portion 6. The housing 2 houses the rotor 3, the motor 4, the multiple stator blade units 5, and the stator cylindrical portion 6.

(Housing 2)

The housing 2 has a case 8, a base 9, and a fixed flange 10. The housing 2 is made of metal such as aluminum alloy or iron. The case 8 is a tubular member having the fixed flange 10 at one end.

The case 8 houses the multiple stator blade units 5 and multiple stages of rotor blade units 22 provided at the rotor 3. The case 8 has a first end portion 11, a second end portion 12, and a side portion 13.

The first end portion 11 is attached to the pumping target device. An inlet port 14 is provided at the first end portion 11. The second end portion 12 is positioned on the side opposite to the fixed flange 10 in an axis direction A1 of the rotor 3. The second end portion 12 is connected to the base 9. The side portion 13 connects the first end portion 11 and the second end portion 12 to each other. A first internal space S1 is formed inside the case 8.

The base 9 is arranged to close an opening of the case 8 on a second end portion 12 side. The base 9 houses the stator cylindrical portion 6 and a rotor cylindrical portion 23 provided at the rotor 3. The base 9 has a base end portion 15 and an outlet port 16. The base end portion 15 is connected to the second end portion 12 of the case 8. A second internal space S2 is formed inside the base 9. The second internal space S2 communicates with the first internal space S1. The outlet port 16 communicates with the second internal space S2.

The fixed flange 10 is connected to the case 8. The fixed flange 10 protrudes from the case 8. The fixed flange 10 is fixed to the pumping target device with bolts 20. Note that "connection" includes joint between separate members. Further, "connection" includes a series of separate portions in an integrated member.

(Rotor 3)

The rotor 3 has a shaft 21, the multiple stages of the rotor blade units 22, and the rotor cylindrical portion 23.

The shaft 21 extends in the axis direction A1 of the rotor 3. In description below, in the axis direction A1, a direction from the case 8 toward the base 9 will be defined as downward, and the opposite direction thereof will be defined as upward.

The vacuum pump 1 includes a protective bearing 29*a* and 29*b* and multiple bearings 24A to 24C. The protective bearing 29*a* and 29*b* functions as a touchdown bearing configured to limit runout of the shaft 21 in a radial direction. The protective bearing 29*a* and 29*b* are attached to the base 9. In a state in which the shaft 21 rotates in a steady state, the shaft 21 and the protective bearing 29*a* or 29*b* do not contact each other. In a case where great disturbance is applied or a case where whirling of the shaft 21 upon acceleration or deceleration of rotation becomes greater, the shaft 21 contacts an inner surface of an inner ring of the protective bearing 29*a* or 29*b*. For example, a ball bearing can be used as the protective bearing 29*a* and 29*b*.

The multiple bearings 24A to 24C rotatably support the rotor 3. The multiple bearings 24A to 24C are attached to the base 9. The multiple bearings 24A to 24C include, for example, magnetic bearings. Note that the multiple bearings 24A to 24C may include other types of bearings such as ball bearings.

The multiple stages of the rotor blade units 22 are connected to the shaft 21. The multiple stages of the rotor blade units 22 are arranged at intervals in the axis direction A1. Each rotor blade unit 22 includes multiple rotor blades 25. Although not shown in the figure, each of the multiple rotor blades 25 radially extends about the shaft 21. Note that in the figure, reference numerals are assigned only to one of the multiple stages of the rotor blade units 22 and one of the multiple rotor blades 25, and reference numerals for the other rotor blade units 22 and the other rotor blades 25 are not shown.

The rotor cylindrical portion 23 is connected to the shaft 21. The rotor cylindrical portion 23 is arranged below the rotor blade units 22. The rotor cylindrical portion 23 is in a cylindrical shape, and extends in the axis direction A1. The rotor cylindrical portion 23 is arranged to surround the shaft 21 on an outer peripheral side thereof. An outer peripheral surface 23*s* of the rotor cylindrical portion 23 is a tubular curved surface.

(Motor 4)

The motor 4 rotatably drives the rotor 3. For example, a DC brushless motor is used as the motor 4. The motor 4 has a motor rotor 26 and a motor stator 27. The motor rotor 26 is attached to the shaft 21. The motor stator 27 is attached to the base 9. The motor stator 27 is arranged to face the motor rotor 26.

(Multiple Stages of Stator Blade Units 5)

The multiple stages of the stator blade units 5 are connected to the case 8. The multiple stages of the stator blade units 5 are arranged at intervals in the axis direction A1. Each of the multiple stages of the stator blade units 5 is arranged between adjacent ones of the multiple stages of the rotor blade units 22. Each stator blade unit 5 includes multiple stator blades 28. Although not shown in the figure, each of the multiple stator blades 28 radially extends about the shaft 21.

The multiple stages of the rotor blade units 22 and the multiple stages of the stator blade units 5 form the turbine portion P1 (the turbo-molecular pump). Note that in the figure, reference numerals are assigned only to one of the multiple stator blade units 5 and one of the multiple stator blades 28, and reference numerals for the other stator blade units 5 and the other stator blades 28 are not shown.

(Stator Cylindrical Portion 6)

The stator cylindrical portion 6 is arranged outside the rotor cylindrical portion 23 in the radial direction. The stator cylindrical portion 6 is connected to the base 9. The stator cylindrical portion 6 is arranged to face the rotor cylindrical portion 23 in the radial direction thereof.

A spiral screw groove 60 (described later) is provided on an inner peripheral surface 6*s* (one example of an opposing surface) of the stator cylindrical portion 6. The rotor cylindrical portion 23 and the stator cylindrical portion 6 form the drag pump portion P2 (the screw groove pump). Note that in FIG. 1, an outward direction of the radial direction B is indicated by B1 and an inward direction of the radial direction B is indicated by B2. Moreover, an end 6*a* of the stator cylindrical portion 6 on an inlet port 14 side is shown, and an end 6*b* of the stator cylindrical portion 6 on an outlet port 16 side is shown.

Figure 2:
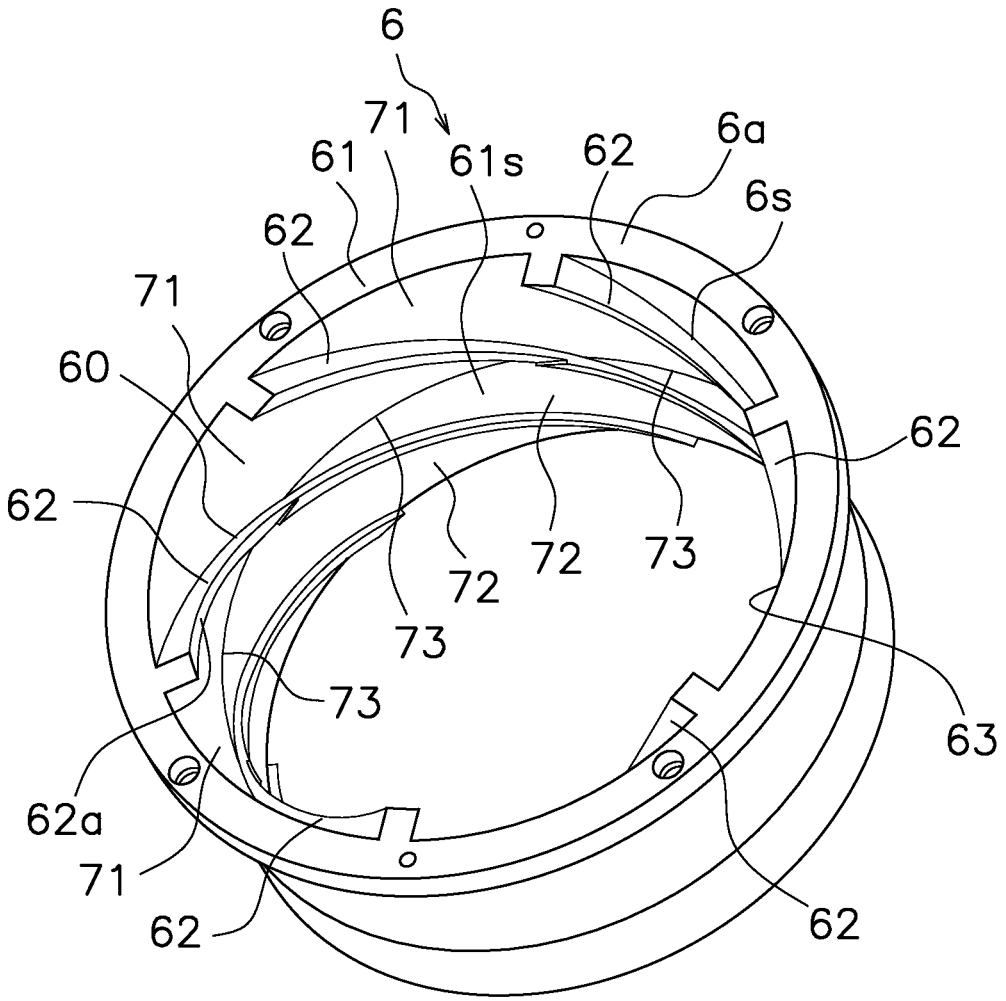
FIG. 2 is a perspective view of a stator cylindrical portion of the vacuum pump according to the first embodiment from a suction side.
Figure 3:
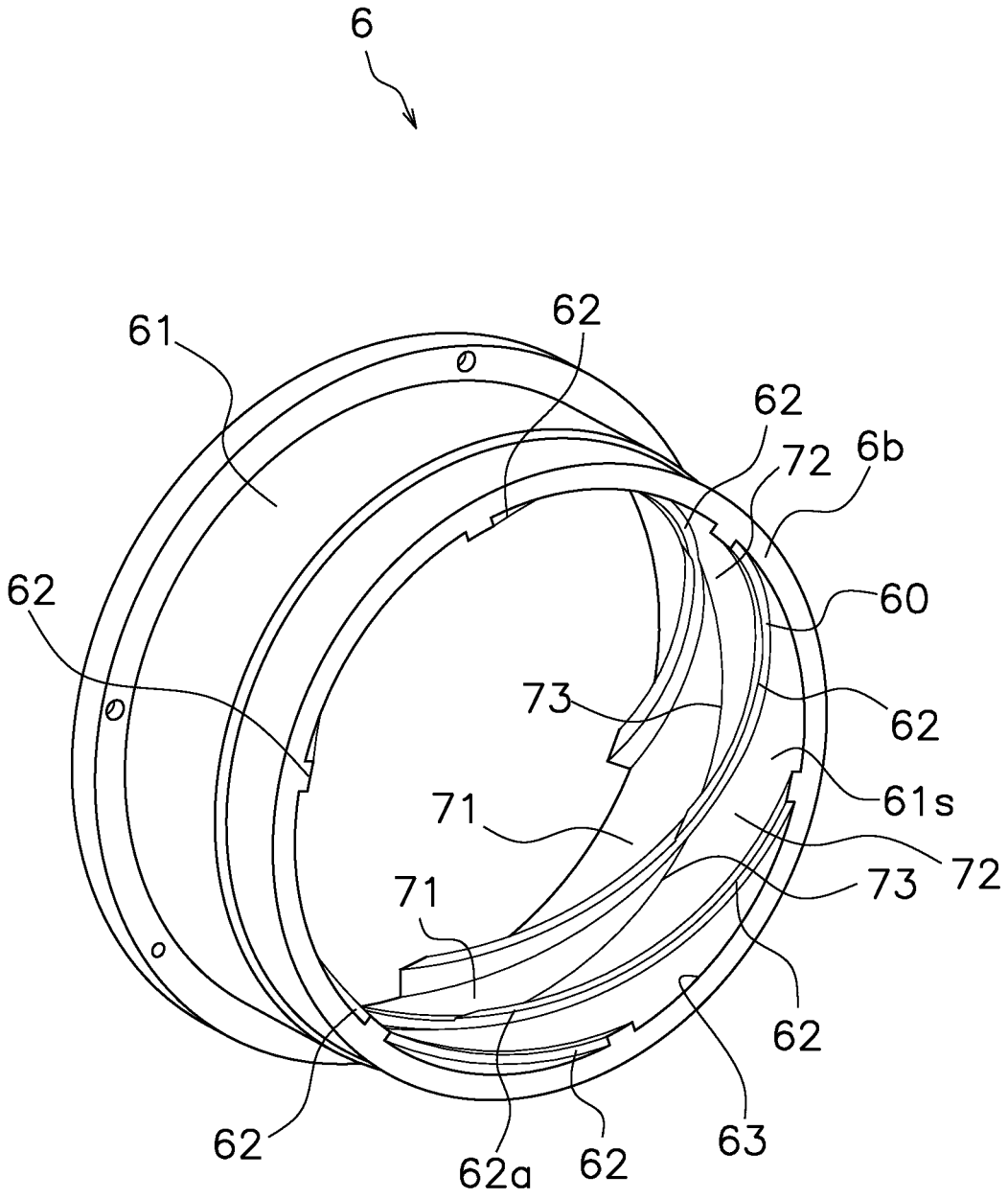
FIG. 3 is a perspective view of the stator cylindrical portion of the vacuum pump according to the first embodiment from the side opposite to that of FIG. 2.

FIG. 2 is a perspective view of the stator cylindrical portion 6 from a suction side. FIG. 3 is a perspective view of the stator cylindrical portion 6 from an exhaust side. The suction side is an upper side on which the inlet port 14 is arranged, and the exhaust side is a lower side on which the outlet port 16 is arranged.

The stator cylindrical portion 6 has the screw groove 60 on the inner peripheral surface 6*s*. The stator cylindrical portion 6 has a cylindrical portion main body 61 and multiple screw threads 62. The multiple screw threads 62 protrude from an inner peripheral surface 61*s* in the inward direction B2 (see FIG. 1). The multiple screw threads 62 are spirally formed from the end 6*a* to the end 6*b*. A tip end of the screw thread 62 protruding in the inward direction B2 is shown as 62*a*. The tip end 62*a* is formed in parallel with the axis direction A1.

The screw groove 60 on the inner peripheral surface 6*s* is formed by the inner peripheral surface 61*s* between the screw threads 62. A screw angle, a groove depth, a screw inner diameter, the number of screw threads, and a groove width ratio which are elements upon design of the screw groove 60 of the stator cylindrical portion 6 will be described.

Figure 4A:
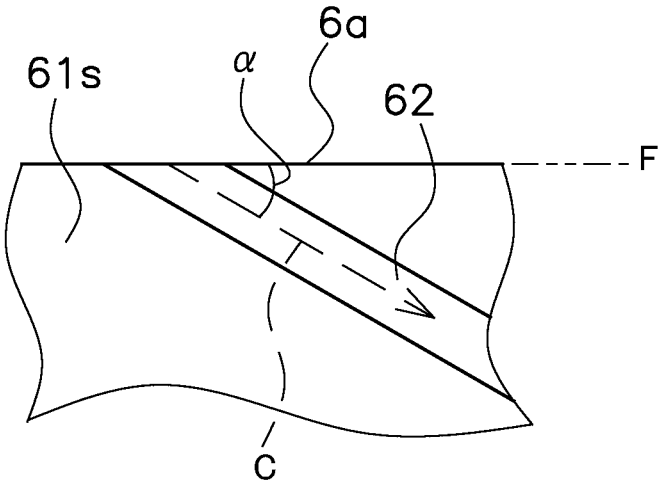
FIG. 4A is a view of a screw thread in the vicinity of a suction side end of the stator cylindrical portion of the vacuum pump according to the first embodiment from the inside.
Figure 4B:
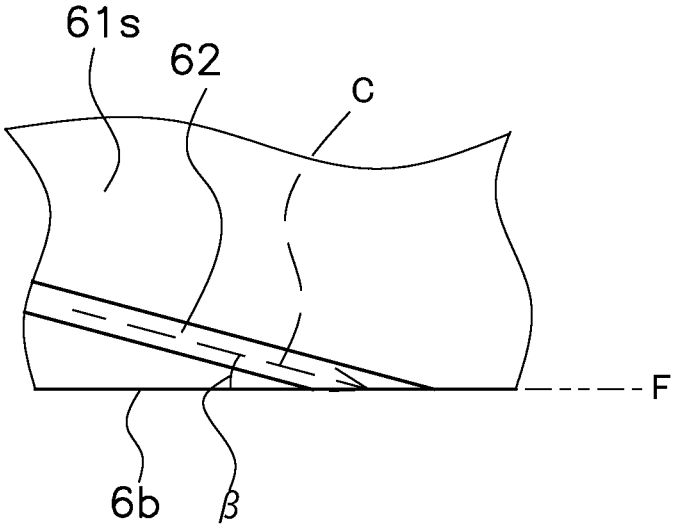
FIG. 4B is a view of the screw thread in the vicinity of an exhaust side end of the stator cylindrical portion of the vacuum pump according to the first embodiment from the inside.

FIG. 4A is a view of the screw thread 62 at the end 6*a* from the inside. FIG. 4B is a view of the screw thread 62 at the end 6*b* from the inside.

The screw angle is an angle with respect to a plane perpendicular to a rotor shaft (the axis direction A1). Such a plane is indicated by a chain double-dashed line F in FIGS. 4A and 4B.

In FIG. 4A, the end 6*a* and the plane F are coincident with each other, and an angle $\alpha$ formed between the direction C of formation of the screw thread 62 and the end 6*a* is a screw angle on the suction side. Moreover, in FIG. 4B, the end 6*b* and the plane F are coincident with each other, and an angle $\beta$ formed between the direction C of formation of the screw thread 62 and the end 6*b* is a screw angle on the exhaust side.

Figure 5:
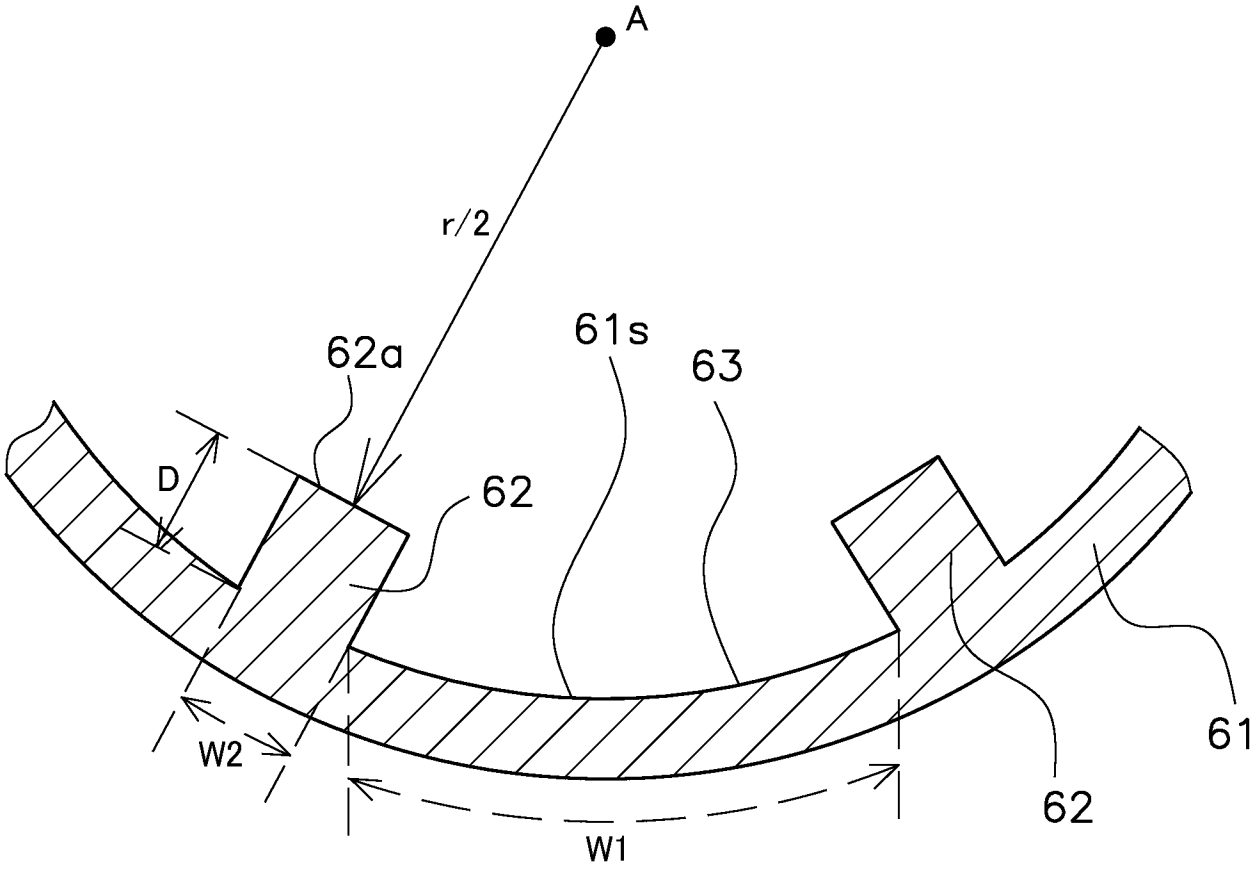
FIG. 5 is a sectional view of the stator cylindrical portion of the vacuum pump according to the first embodiment along a plane perpendicular to a screw angle.

FIG. 5 is a view showing a section perpendicular to the direction (the angle of the screw thread) of formation of the spiral screw thread 62.

A portion between adjacent ones of the screw threads 62 forms a groove portion 63, and the inner peripheral surface 61*s* serves as a groove bottom of the groove portion 63. A groove depth D is a length from the inner tip end 62*a* of the screw thread 62 to the inner peripheral surface 61*s* of the cylindrical portion main body 61. Although described later in detail with reference to FIG. 6, the groove depth D of the screw groove 60 decreases from the end 6*a* toward the end 6*b*. It can also be said that a height from the inner peripheral surface 61*s* to the tip end of the screw thread 62 decreases from the end 6*a* toward the end 6*b*.

The screw inner diameter is a diameter inside the tip end 62*a* of the screw thread 62. The screw inner diameter is set by the outer diameter of the rotor cylindrical portion 23 and a clearance between the rotor cylindrical portion 23 and the tip end 62*a* of the screw thread 62. In FIG. 5, the radius of the screw inner diameter is indicated by r/2.

The number of screw threads is the number of screw threads 62 arranged within 360 degrees in a circumferential direction. In the present embodiment, six screw threads 62 are formed as one example as shown in FIGS. 2 and 3. The six screw threads 62 are arranged at an interval of 60 degrees in a section perpendicular to the axis direction A1.

The groove width ratio is the ratio of the width W1 of the groove portion 63 to the sum of the width W1 of the groove portion 63 and the width W2 of the screw thread 62 in the section perpendicular to the direction of formation of the screw thread 62. That is, the groove width ratio is represented by W1/(W1+W2), and is a value of greater than 0 and less than 1.

Figure 6:
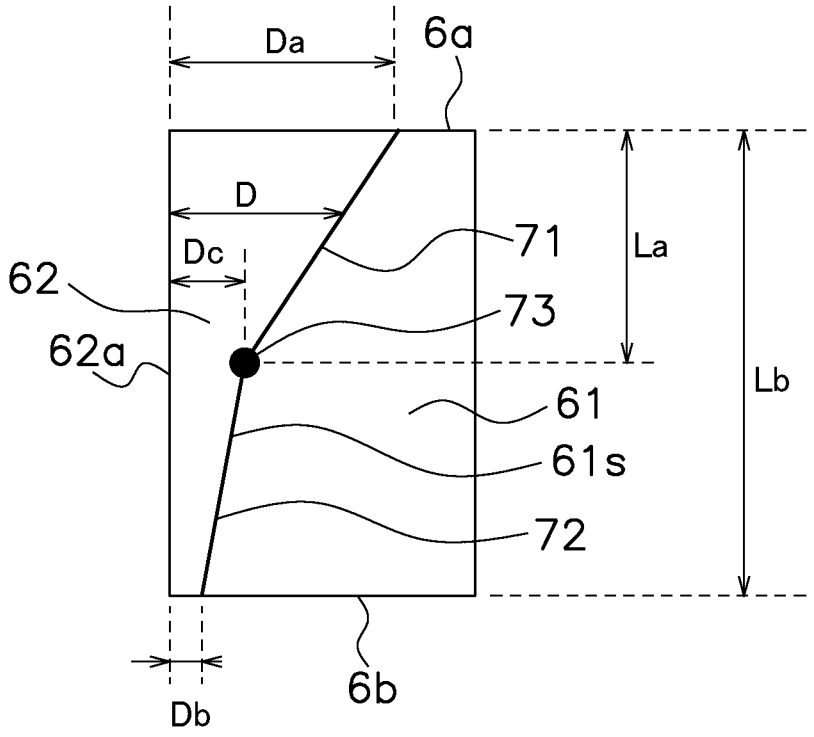
FIG. 6 is a view showing a change in the screw groove depth of the stator cylindrical portion of the vacuum pump according to the first embodiment.

FIG. 6 is a view showing a change in the groove depth D in the axis direction A1. In FIG. 6, the upper side shows the suction side, and the lower side shows the exhaust side. The groove depth D at the end 6*a* is indicated as a suction side groove depth Da. The groove depth D at the end 6*b* is indicated as an exhaust side groove depth Db.

The exhaust side groove depth Db is smaller than the suction side groove depth Da. The groove depth D decreases from the end 6*a* toward the end 6*b*.

The inner peripheral surface 61*s* of the cylindrical portion main body 61 has a suction side portion 71 (one example of a first portion) and an exhaust side portion 72 (one example of a second portion). The suction side portion 71 is a portion of which groove depth D decreases at a constant decrement Ea. The exhaust side portion 72 is arranged on an end 6*b* side (the exhaust side) with respect to the suction side portion 71. The exhaust side portion 72 is a portion of which groove depth D decreases at a constant decrement Eb. The decrement Eb of the exhaust side portion 72 is smaller than the decrement Ea of the suction side portion 71, and Ea>Eb is set. The decrement is obtained in such a manner that the amount of decrease in the groove depth D upon movement from the end 6*a* toward the end 6*b* by a predetermined amount along the axis direction A1 is divided by the predetermined amount.

An end of the suction side portion 71 on the end 6*b* side is connected to an end of the exhaust side portion 72 on an end 6*a* side. Since the decrements are constant, the suction side portion 71 and the exhaust side portion 72 are linearly shown in FIG. 6. A connection portion between the suction side portion 71 and the exhaust side portion 72 is shown as a change portion 73 at which the decrement changes. The groove depth D at the change portion 73 is indicated as a change portion groove depth Dc. As shown in FIGS. 2 and 3, the change portion 73 is formed along a circumference on a plane perpendicular to the axis direction A1. Moreover, in FIGS. 2 and 3, a step is formed at the tip end 62*a* of the screw thread 62 on such a circumference, but is not necessarily formed. Note that FIG. 6 and FIGS. 7, 14 to 17, and 26 described later show a state in which no step is formed at the tip end 62*a*.

The suction side groove depth Da, the exhaust side groove depth db, and the change portion groove depth Dc preferably satisfy (Expression 1) below.

$$db \leq Dc \leq (Da+db) \times 0.5 \quad \text{(Expression 1)}$$

The suction side groove depth Da, the exhaust side groove depth db, and the change portion groove depth Dc more preferably satisfy (Expression 2) below.

$$1.5 \leq Da/db \quad \text{(Expression 2)}$$

The suction side groove depth Da preferably satisfies (Expression 3) below.

$$8\ \text{mm} \leq Da \quad \text{(Expression 3)}$$

Assuming that a length from the end 6*a* to the change portion 73 along the axis direction A1 is La and a length from the end 6*a* to the end 6*b* along the axis direction A1 is Lb, (Expression 4) below is preferably satisfied.

$$0 < La < Lb \times 2/3 \quad \text{(Expression 4)}$$

With the above-described configuration, the decrement of the groove depth D is set greater on the suction port 14 side than on the exhaust port 16 side, and therefore, gas molecules are easily sent from the inlet port 14 side to the outlet port 16 side in the screw groove 60. Moreover, the decrement of the groove depth D is set smaller on the exhaust port 16 side than the inlet port 14 side, and therefore, a backflow of gas molecules from the outlet port 16 side to the inlet port 14 side in the screw groove 60 can be prevented.

Thus, even in a case where a great suction side conductance of the drag pump portion P2 formed by the rotor cylindrical portion 23 and the stator cylindrical portion 6 is set, back pressure properties can be improved. Note that the conductance of the drag pump portion P2 can be increased by expansion of a gas flow path. That is, a flow path of the groove portion 63 of the screw groove 60 is expanded so that the conductance of the drag pump portion P2 can be improved. The flow path of the groove portion 63 can be expanded by an increase in the groove depth D, a decrease in the number of screw threads 62 forming the screw groove 60, or an increase in the groove width ratio W1/(W1+W2).

EXAMPLES

Hereinafter, the vacuum pump 1 of the present embodiment will be further described with reference to examples.

In first to third examples, each element of a drag pump portion P2 is changed for performance calculation, as shown in (Table 1) to (Table 3) for each example.

Figure 7:
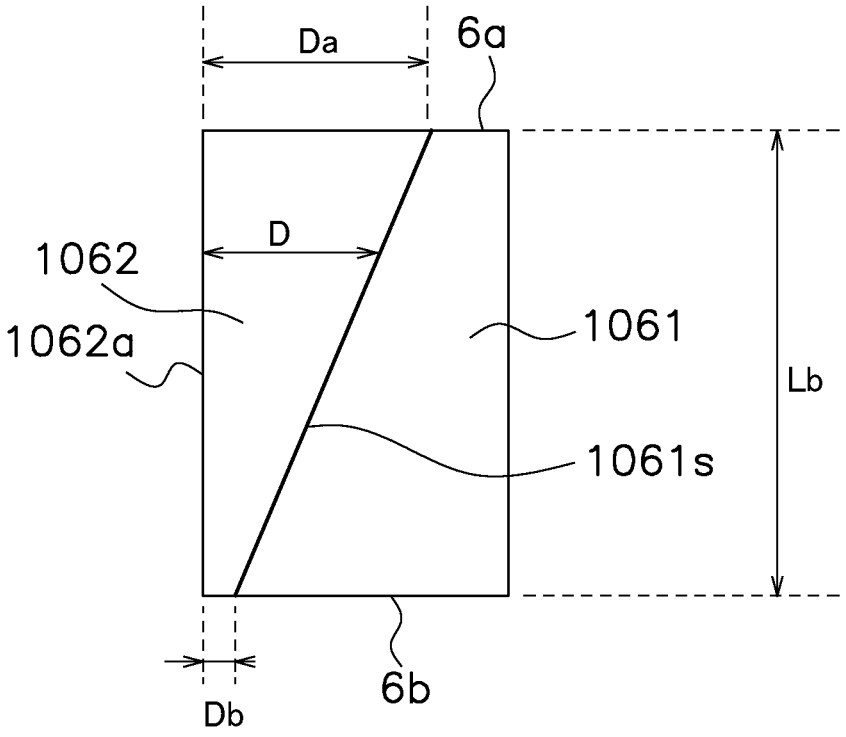
FIG. 7 is a view showing a change in a screw groove depth in a comparative example.

In each example, performance calculation for a comparative example is also simultaneously performed. FIG. 7 is a view showing a change in a groove depth D in a cylindrical portion main body 1061 and a screw thread 1062 of the comparative example. The groove depth D from a tip end 1062*a* of the screw thread 1062 to an inner peripheral surface 1061*s* of the cylindrical portion main body 1061 decreases from an end 6*a* toward an end 6*b* at a constant rate, and changes linearly. That is, no groove depth change portion is, unlike the examples, provided in the comparative example.

First Example

Figure 8:
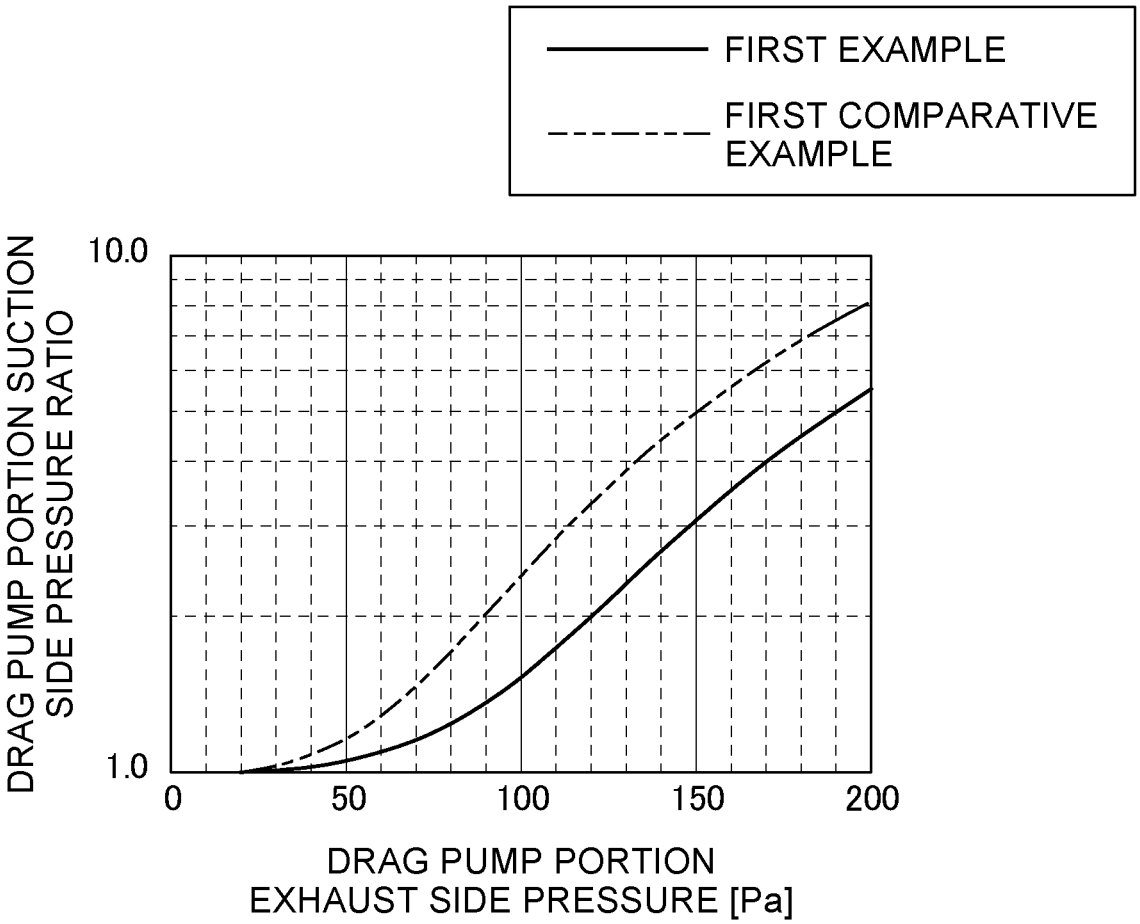
FIG. 8 is a graph showing a change in a suction side pressure in association with the exhaust side pressure of a drag pump portion in a first example and a first comparative example.
Figure 9:
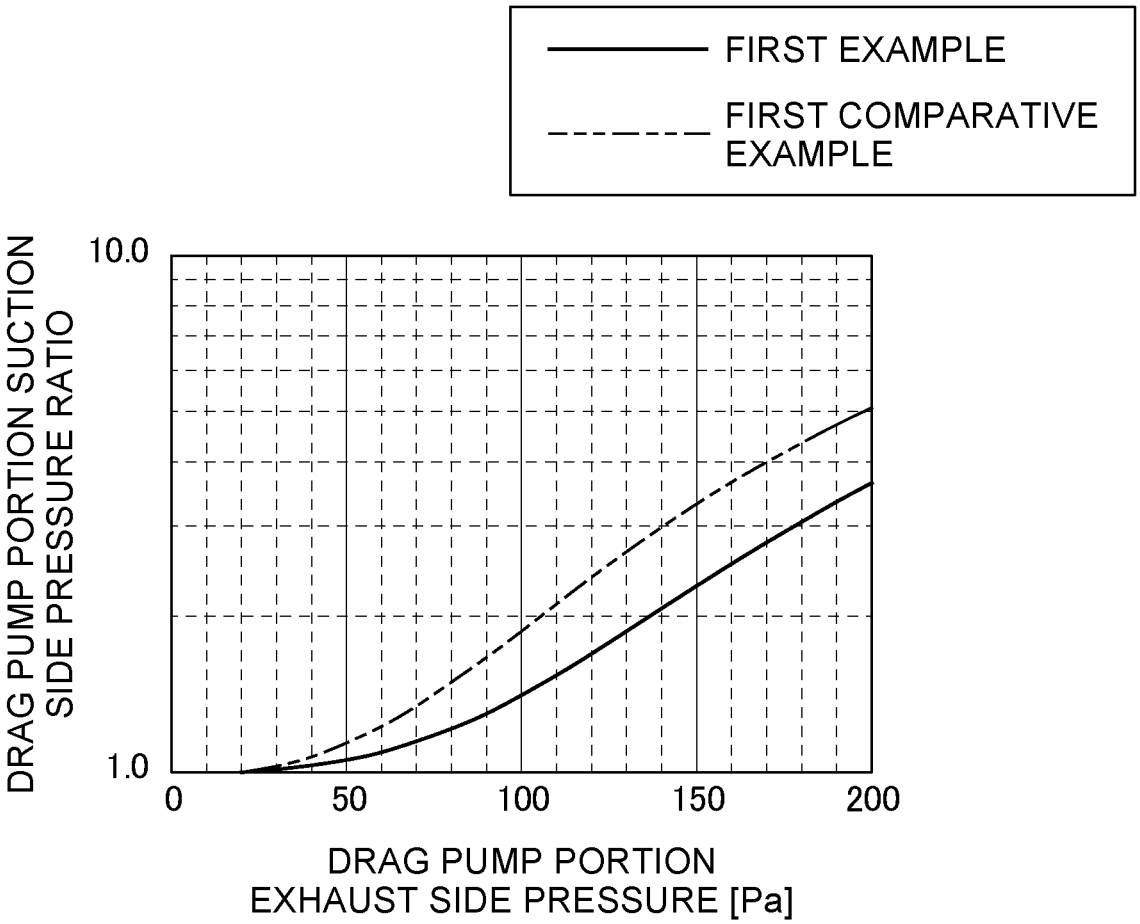
FIG. 9 is a graph showing the change in the suction side pressure in association with the exhaust side pressure of the drag pump portion in the first example and the first comparative example.

Each element of the drag pump portion P2 is set to a value shown in (Table 1), and performance calculation results are shown in FIGS. 8 and 9.

TABLE 1

| Element | | Numerical Value |
|---|---|---|
| Screw Angle | Suction Side a | 30° |
| | Exhaust Side b | 15° |
| Groove Depth | Suction Side Da | 15 mm |
| | Exhaust Side Db | 5 mm |
| Screw Thread Diameter | | 220 mm |
| Number of Screw Threads | | 6 |
| Groove Width Ratio | | 0.9 |
| Stator Cylindrical Portion Height Lb | | 120 mm |
| Radius Clearance between Rotor Cylindrical Portion and Stator Cylindrical Portion | | 0.3 mm |

At a screw groove 60 of the first example, a change portion 73 of which groove depth Dc is 7 mm is provided at a position of 50% of Lb (La=Lb/2).

FIG. 8 is a graph showing a relationship between a suction side pressure and an exhaust side pressure of the drag pump portion P2 when an $N_2$ of 2000 sccm is pumped in the first example and the first comparative example. FIG. 9 is a graph showing a relationship between the suction side pressure and the exhaust side pressure of the drag pump portion P2 when an $N_2$ of 3000 sccm is pumped in the first example and a first comparative example. In FIGS. 8 and 9, the horizontal axis indicates the exhaust side pressure, and the vertical axis indicates a suction side pressure ratio. The suction side pressure ratio is a ratio with reference to the suction side pressure of the drag pump portion P2 when the exhaust side pressure of the drag pump portion P2 is 20 Pa. In FIGS. 8 and 9, the first example is indicated by a solid line, and the first comparative example is indicated by a chain double-dashed line.

As shown in FIGS. 8 and 9, even in the case of pumping a great amount such as 2000 sccm or 3000 sccm, an increase in the suction side pressure due to an increase in the exhaust side pressure is suppressed in the first example as compared to the first comparative example. Thus, it shows that in the first example, back pressure properties are improved as compared to the first comparative example.

Second Example

Figure 10:
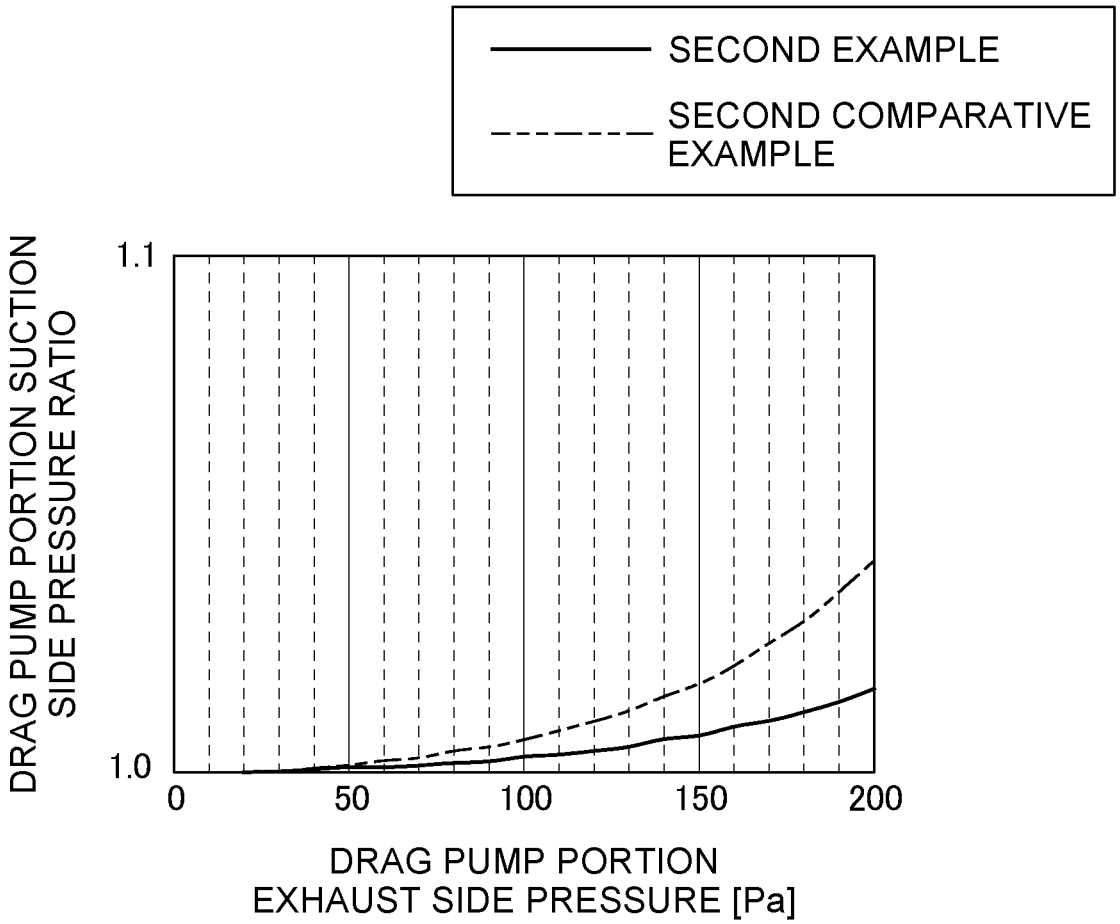
FIG. 10 is a graph showing a change in a suction side pressure in association with the exhaust side pressure of a drag pump portion in a second example and a second comparative example.
Figure 11:
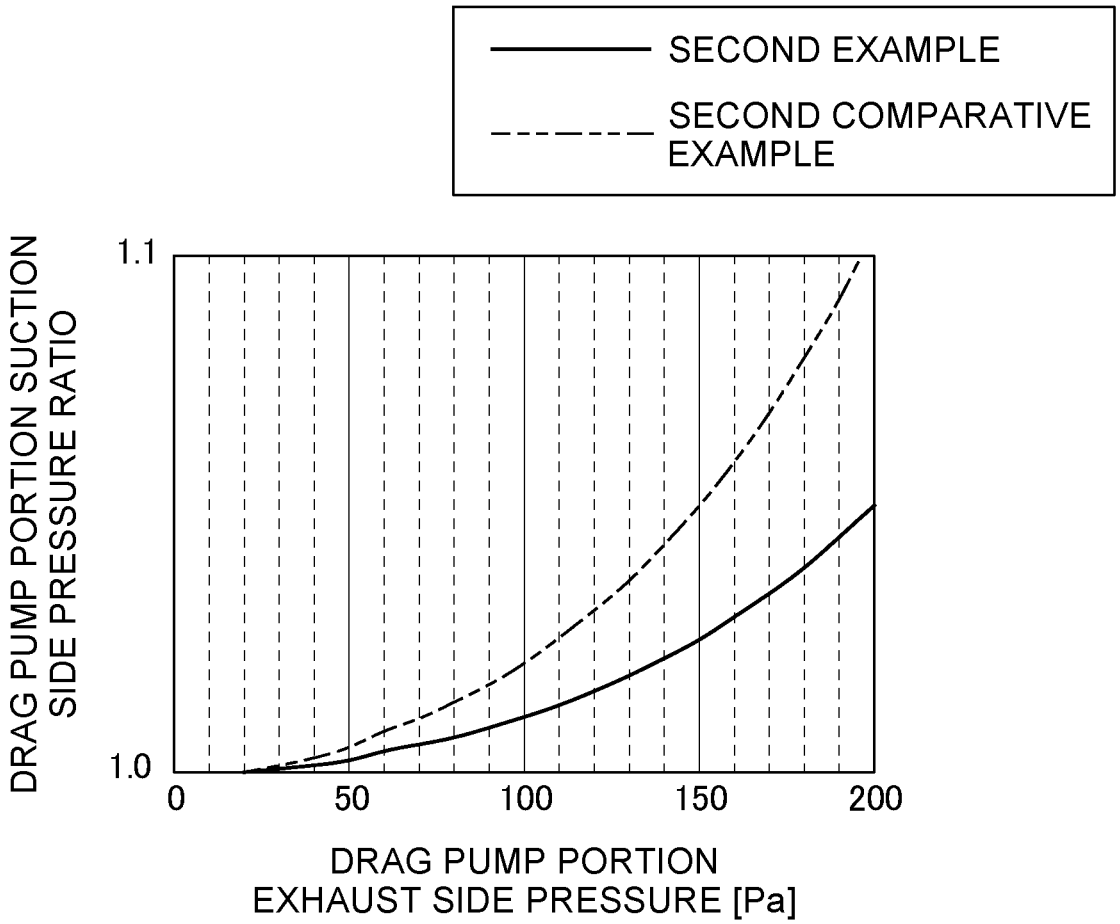
FIG. 11 is a graph showing the change in the suction side pressure in association with the exhaust side pressure of the drag pump portion in the second example and the second comparative example.

Each element of the drag pump portion P2 is set to a value shown in (Table 2), and performance calculation results are shown in FIGS. 10 and 11.

TABLE 2

| Element | | Numerical Value |
|---|---|---|
| Screw Angle | Suction Side a | 20° |
| | Exhaust Side b | 20° |
| Groove Depth | Suction Side Da | 9 mm |
| | Exhaust Side Db | 1 mm |
| Screw Thread Diameter | | 220 mm |
| Number of Screw Threads | | 8 |
| Groove Width Ratio | | 0.9 |
| Stator Cylindrical Portion Height Lb | | 120 mm |
| Radius Clearance between Rotor Cylindrical Portion and Stator Cylindrical Portion | | 0.3 mm |

At a screw groove 60 of the second example, a change portion 73 of which groove depth Dc is 4 mm is provided at a position of 50% of Lb (La=Lb/2).

FIG. 10 is a graph showing a relationship between a suction side pressure and an exhaust side pressure of the drag pump portion P2 when an $N_2$ of 2000 sccm is pumped in the second example and a second comparative example. FIG. 11 is a graph showing a relationship between the suction side pressure and the exhaust side pressure of the drag pump portion P2 when an $N_2$ of 3000 sccm is pumped in the second example and the second comparative example. In FIGS. 10 and 11, the horizontal axis indicates the exhaust side pressure, and the vertical axis indicates a suction side pressure ratio. The suction side pressure ratio is a ratio with reference to the suction side pressure of the drag pump portion P2 when the exhaust side pressure of the drag pump portion P2 is 20 Pa. In FIGS. 10 and 11, the second example is indicated by a solid line, and the second comparative example is indicated by a chain double-dashed line.

As shown in FIGS. 10 and 11, even in the case of pumping a great amount such as 2000 sccm or 3000 sccm, an increase in the suction side pressure due to an increase in the exhaust side pressure is suppressed in the second example as compared to the second comparative example. Thus, it shows that in the second example, back pressure properties are improved as compared to the second comparative example.

Third and Fourth Examples

Figure 12:
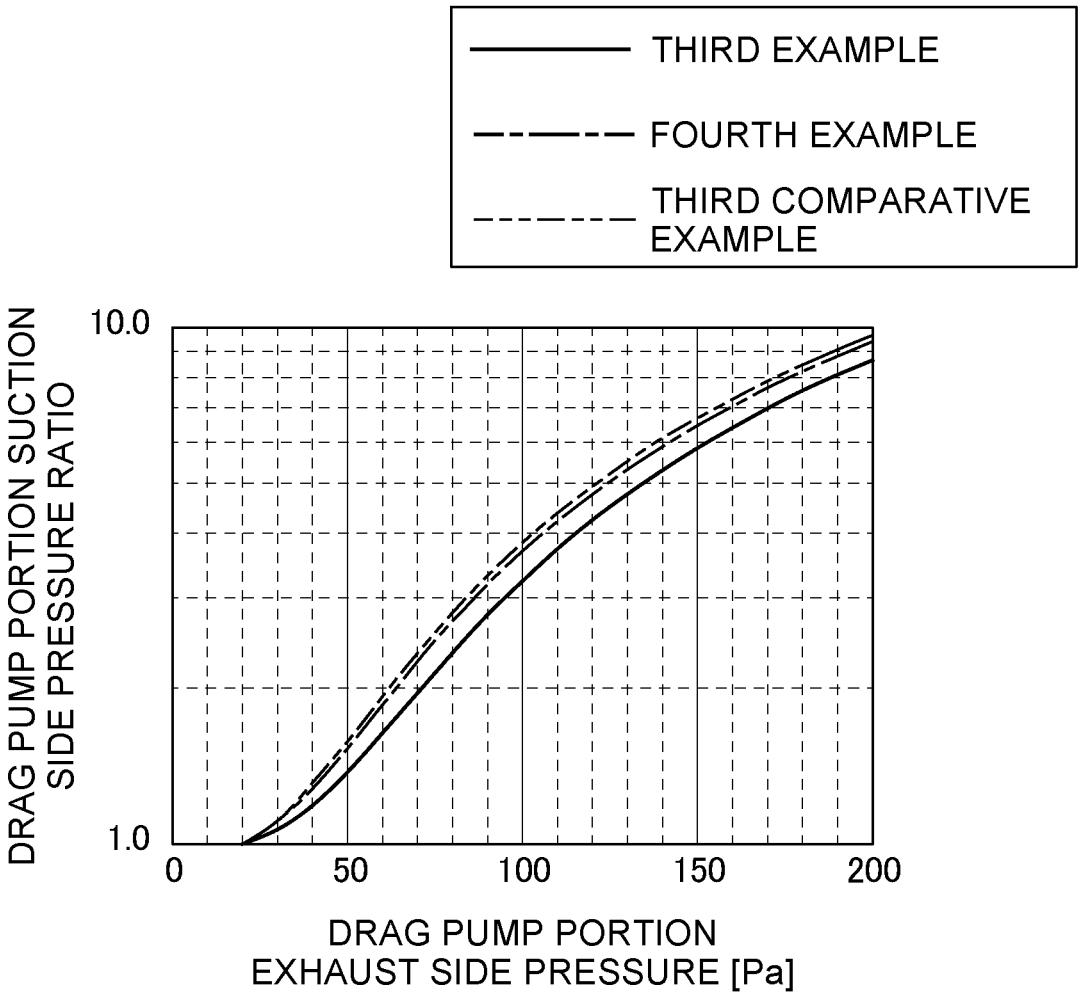
FIG. 12 is a graph showing a change in a suction side pressure in association with the exhaust side pressure of a drag pump portion in third and fourth examples and the second comparative example.
Figure 13:
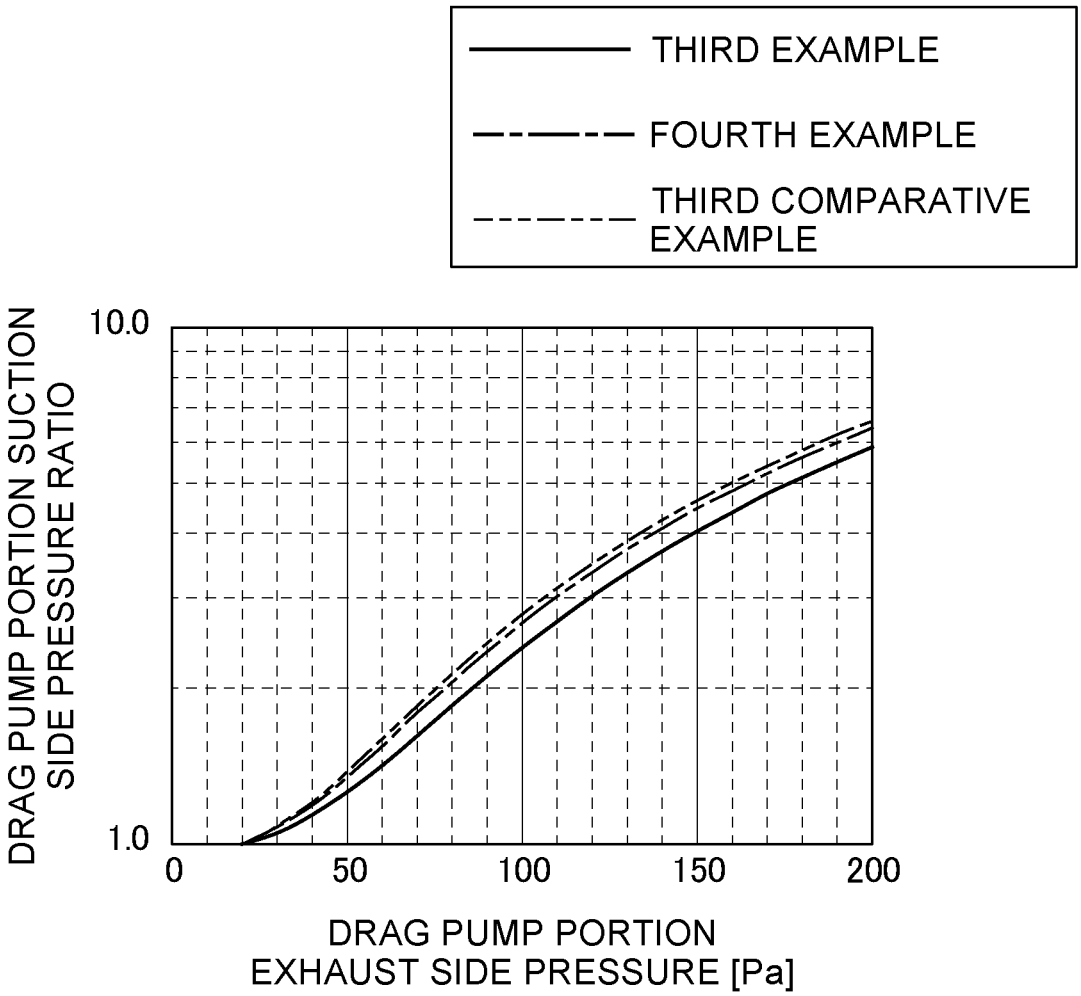
FIG. 13 is a graph showing the change in the suction side pressure in association with the exhaust side pressure of the drag pump portion in the third and fourth examples and the second comparative example.

Each element of the drag pump portion P2 is set to a value shown in (Table 3), and performance calculation results are shown in FIGS. 12 and 13.

TABLE 3

| Element | | Numerical Value |
|---|---|---|
| Screw Angle | Suction Side a | 25° |
| | Exhaust Side b | 15° |
| Groove Depth | Suction Side Da | 18 mm |
| | Exhaust Side Db | 10 mm |

TABLE 3-continued

| Element | Numerical Value |
|---|---|
| Screw Thread Diameter | 220 mm |
| Number of Screw Threads | 5 |
| Groove Width Ratio | 0.7 |
| Stator Cylindrical Portion Height Lb | 120 mm |
| Radius Clearance between Rotor Cylindrical Portion and Stator Cylindrical Portion | 0.3 mm |

At a screw groove 60 of the third example, a change portion 73 of which groove depth Dc is 12 mm is provided at a position of 33% of Lb (La=0.33×Lb).

At a screw groove 60 of a fourth example, a change portion 73 of which groove depth Dc is 12 mm is provided at a position of 66% of Lb (La=0.66×Lb).

FIG. 12 is a graph showing a relationship between a suction side pressure and an exhaust side pressure of the drag pump portion P2 when an $N_2$ of 2000 sccm is pumped in the third and fourth examples and a third comparative example. FIG. 13 is a graph showing a relationship between the suction side pressure and the exhaust side pressure of the drag pump portion P2 when an $N_2$ of 3000 sccm is pumped in the third and fourth examples and the third comparative example. In FIGS. 12 and 13, the horizontal axis indicates the exhaust side pressure, and the vertical axis indicates a suction side pressure ratio. The suction side pressure ratio is a ratio with reference to the suction side pressure of the drag pump portion P2 when the exhaust side pressure of the drag pump portion P2 is 20 Pa. In FIGS. 12 and 13, the third example is indicated by a solid line, the fourth example is indicated by a chain line, and the third comparative example is indicated by a chain double-dashed line.

As shown in FIGS. 12 and 13, even in the case of pumping a great amount such as 2000 sccm or 3000 sccm, an increase in the suction side pressure due to an increase in the exhaust side pressure is suppressed in the third and fourth examples as compared to the third comparative example. Thus, it shows that in the third and fourth examples, back pressure properties are improved as compared to the third comparative example.

Second Embodiment

Hereinafter, a vacuum pump of a second embodiment will be described. The vacuum pump of the second embodiment is different from the vacuum pump of the first embodiment in a change in the groove depth D of a screw groove 60 of a stator cylindrical portion 6. The differences from the first embodiment will be mainly described in the second embodiment.

At the stator cylindrical portion 6 of the first embodiment above, the single change portion at which the decrement of the groove depth D changes is provided between the end 6*a* on the suction side and the end 6*b* on the exhaust side. However, at the stator cylindrical portion of the second embodiment, multiple change portions are provided.

Figure 14:
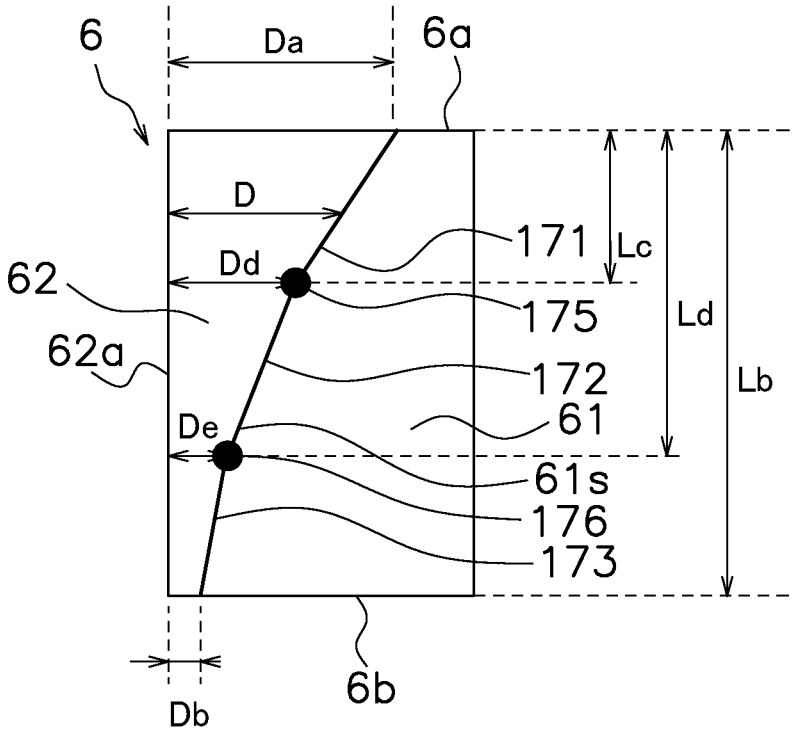
FIG. 14 is a view showing a change in the screw groove depth of a stator cylindrical portion of a vacuum pump according to a second embodiment.

FIG. 14 is a view showing a change in the groove depth D in an axis direction A1 at the stator cylindrical portion 6 of the second embodiment.

In FIG. 14, the upper side shows a suction side, and the lower side shows an exhaust side. A groove depth D at an end 6*a* is indicated as a suction side groove depth Da. A groove depth D at an end 6*b* is indicated as an exhaust side groove depth db. The exhaust side groove depth db is smaller than the suction side groove depth Da.

An inner peripheral surface 61*s* of a cylindrical portion main body 61 of the second embodiment has a first decreasing portion 171, a second decreasing portion 172, and a third decreasing portion 173 arranged in this order from the suction side toward the exhaust side. The first decreasing portion 171 is a portion of which groove depth D decreases at a constant decrement E1. The second decreasing portion 172 is a portion of which groove depth D decreases at a constant decrement E2. The third decreasing portion 173 is a portion of which groove depth D decreases at a constant decrement E3. The decrement is obtained in such a manner that the amount of decrease in the groove depth D upon movement from the end 6*a* toward the end 6*b* along the axis direction A1 by a predetermined amount is divided by the predetermined amount. Since the decrements are constant, the first decreasing portion 171, the second decreasing portion 172, and the third decreasing portion 173 are linearly shown in FIG. 14.

The first decreasing portion 171 is formed from the end 6*a* toward the exhaust side. An end of the first decreasing portion 171 on the exhaust side is connected to an end of the second decreasing portion 172 on the suction side. A connection portion between the first decreasing portion 171 and the second decreasing portion 172 is shown as a first change portion 175 at which the decrement changes. The groove depth D at the first change portion 175 is indicated as a change portion groove depth Dd. The first change portion 175 is formed on a circumference on a plane perpendicular to the axis direction A1.

The third decreasing portion 173 is formed from the end 6*b* toward the suction side. An end of the third decreasing portion 173 on the suction side is connected to an end of the second decreasing portion 172 on the exhaust side. A connection portion between the second decreasing portion 172 and the third decreasing portion 173 is shown as a second change portion 176 at which the decrement changes. The groove depth D at the second change portion 176 is indicated as a change portion groove depth De. The second change portion 176 is formed on a circumference on a plane perpendicular to the axis direction A1.

At the stator cylindrical portion shown in FIG. 14, Decrement E1 of First Decreasing Portion 171≥Decrement E2 of Second Decreasing Portion 172≥Decrement E3 of Third Decreasing Portion 173 is set.

Figure 15:
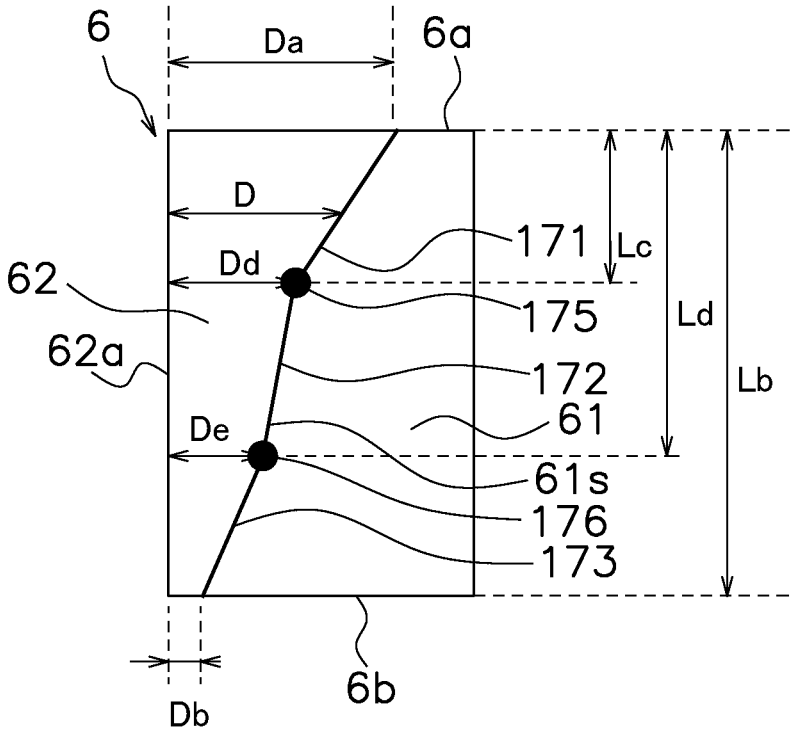
FIG. 15 is a view showing the change in the screw groove depth of the stator cylindrical portion of the vacuum pump according to the second embodiment.
Figure 16:
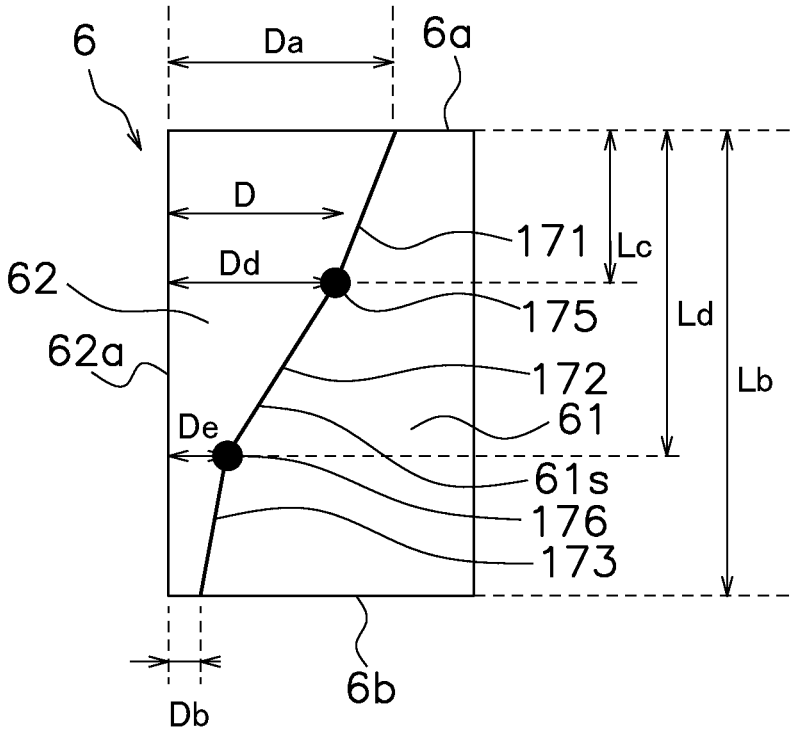
FIG. 16 is a view showing the change in the screw groove depth of the stator cylindrical portion of the vacuum pump according to the second embodiment.

Note that the present invention is not limited to the configuration of FIG. 14, and, e.g., the configuration of a stator cylindrical portion as shown in FIG. 15 or 16 may be employed as long as the groove depth db at the end 6*b* on the exhaust side is smaller than the groove depth Da at the end 6*a* on the suction side and the decrement of the groove depth is greater on the suction side than on the exhaust side.

As compared to the stator cylindrical portion shown in FIG. 14, at the stator cylindrical portion 6 shown in FIG. 15, Decrement E1 of First Decreasing Portion 171≥Decrement E3 of Third Decreasing Portion 173≥Decrement E2 of Second Decreasing Portion 172 is set.

As compared to the stator cylindrical portion shown in FIG. 14, at the stator cylindrical portion 6 shown in FIG. 16, Decrement E2 of Second Decreasing Portion 172≥Decrement E1 of First Decreasing Portion 171≥Decrement E3 of Third Decreasing Portion 173 is set.

Figure 17:
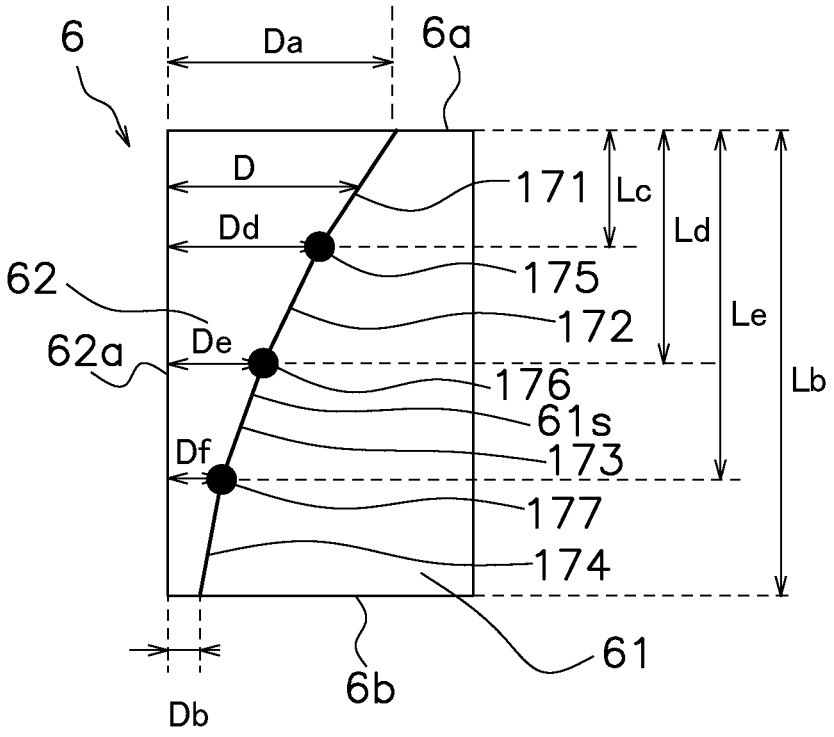
FIG. 17 is a view showing the change in the screw groove depth of the stator cylindrical portion of the vacuum pump according to the second embodiment.

At each stator cylindrical portion shown in FIGS. 14 to 16, two change portions at which the decrement changes are provided, but three change portions may be provided. FIG. 17 is a view showing a change in the groove depth D in the axis direction A1 at a stator cylindrical portion provided with three change portions at which the decrement of the groove depth changes.

In the configuration shown in FIG. 17, a fourth decreasing portion 174 is further provided between the third decreasing portion 173 described with reference to FIG. 14 and the end 6*b*. A connection portion between the third decreasing portion 173 and the fourth decreasing portion 174 is indicated as a third change portion 177. The fourth decreasing portion 174 is a portion of which groove depth D decreases at a constant decrement E4. In the configuration shown in FIG. 17, Decrement E1 of First Decreasing Portion 171≥Decrement E2 of Second Decreasing Portion 172≥Decrement E3 of Third Decreasing Portion 173≥Decrement E4 of Fourth Decreasing Portion 174 is set. Moreover, the groove depth at the third change portion 177 is indicated as a change portion groove depth Df.

As described above, the stator cylindrical portion may be configured such that the four portions with the different constant decrements are provided and the three change portions at which the decrement changes are provided.

Note that in the configuration shown in FIG. 17, the magnitude of the decrement may be different among the decreasing portions as long as the groove depth db at the end 6*b* on the exhaust side is smaller than the groove depth Da at the end 6*a* on the suction side and the decrement of the groove depth is greater on the suction side than on the exhaust side. Although not shown in the figure, e.g., Decrement E1 of First Decreasing Portion 171≥Decrement E2 of Second Decreasing Portion 172≥Decrement E4 of Fourth Decreasing Portion 174≥Decrement E3 of Third Decreasing Portion 173 may be set as in the cases (FIGS. 14 to 16) of the configuration provided with the two change portions. As described in eighth to fifteenth examples below, the magnitude relations of the decrement E1 of the first decreasing portion 171, the decrement E2 of the second decreasing portion 172, the decrement E3 of the third decreasing portion 173, and the decrement E4 of the fourth decreasing portion 174 are changeable.

Examples

Hereinafter, the embodiment will be described in detail with reference to examples.

Fifth to Seventh Examples

In fifth to seventh examples and a fourth comparative example below, each element of a drag pump portion P2 is set to a value shown in (Table 4).

TABLE 4

| Element | | Numerical Value |
|---|---|---|
| Screw Angle | Suction Side a | 30° |
| | Exhaust Side b | 15° |
| Groove Depth | Suction Side Da | 12 mm |
| | Exhaust Side Db | 4 mm |
| Screw Thread Diameter | | 200 mm |
| Number of Screw Threads | | 8 |
| Groove Width Ratio | | 0.9 |
| Stator Cylindrical Portion Height Lb | | 100 mm |
| Radius Clearance between Rotor Cylindrical Portion and Stator Cylindrical Portion | | 0.4 mm |

A length Lc from an end 6*a* of a stator cylindrical portion 6 on a suction side to a first change portion 175 is set to 40 mm, and a length Ld from the end 6*a* to a second change portion 176 is set to 70 mm.

The stator cylindrical portion in the fifth example is in a shape shown in FIG. 14, and Decrement E1 of First Decreasing Portion 171≥Decrement E2 of Second Decreasing Portion 172≥Decrement E3 of Third Decreasing Portion 173 is set.

The stator cylindrical portion in the sixth example is in a shape shown in FIG. 15, and Decrement E1 of First Decreasing Portion 171≥Decrement E3 of Third Decreasing Portion 173≥Decrement E2 of Second Decreasing Portion 172 is set.

The stator cylindrical portion in the seventh example is in a shape shown in FIG. 16, and Decrement E2 of Second Decreasing Portion 172≥Decrement E1 of First Decreasing Portion 171≥Decrement E3 of Third Decreasing Portion 173 is set.

The stator cylindrical portion in the fourth comparative example is in the above-described shape of FIG. 7, and a groove depth D decreases from the end 6*a* toward an end 6*b* at a constant rate and changes linearly.

(Table 5) below shows the dimensions of the stator cylindrical portion in the fourth comparative example and the fifth to seventh examples.

TABLE 5

| | Fourth Comparative Example | Fifth Example | Sixth Example | Seventh Example |
|---|---|---|---|---|
| Suction Side Groove Depth Da | 12 mm | 12 mm | 12 mm | 12 mm |
| Groove Depth Dd at First Change Portion | Not Set (8.8 mm) | 7.5 mm | 7.5 mm | 8.5 mm |
| Groove Depth De at Second Change Portion | Not Set (6.4 mm) | 5 mm | 6.5 mm | 5 mm |
| Exhaust Side Groove Depth Db | 4 mm | 4 mm | 4 mm | 4 mm |
| Decrement E1 of Groove Depth at First Decreasing Portion | 0.080 | 0.113 | 0.113 | 0.088 |
| Decrement E2 of Groove Depth at Second Decreasing Portion | 0.080 | 0.083 | 0.033 | 0.117 |
| Decrement E3 of Groove Depth at Third Decreasing Portion | 0.080 | 0.033 | 0.083 | 0.033 |

Figure 18:
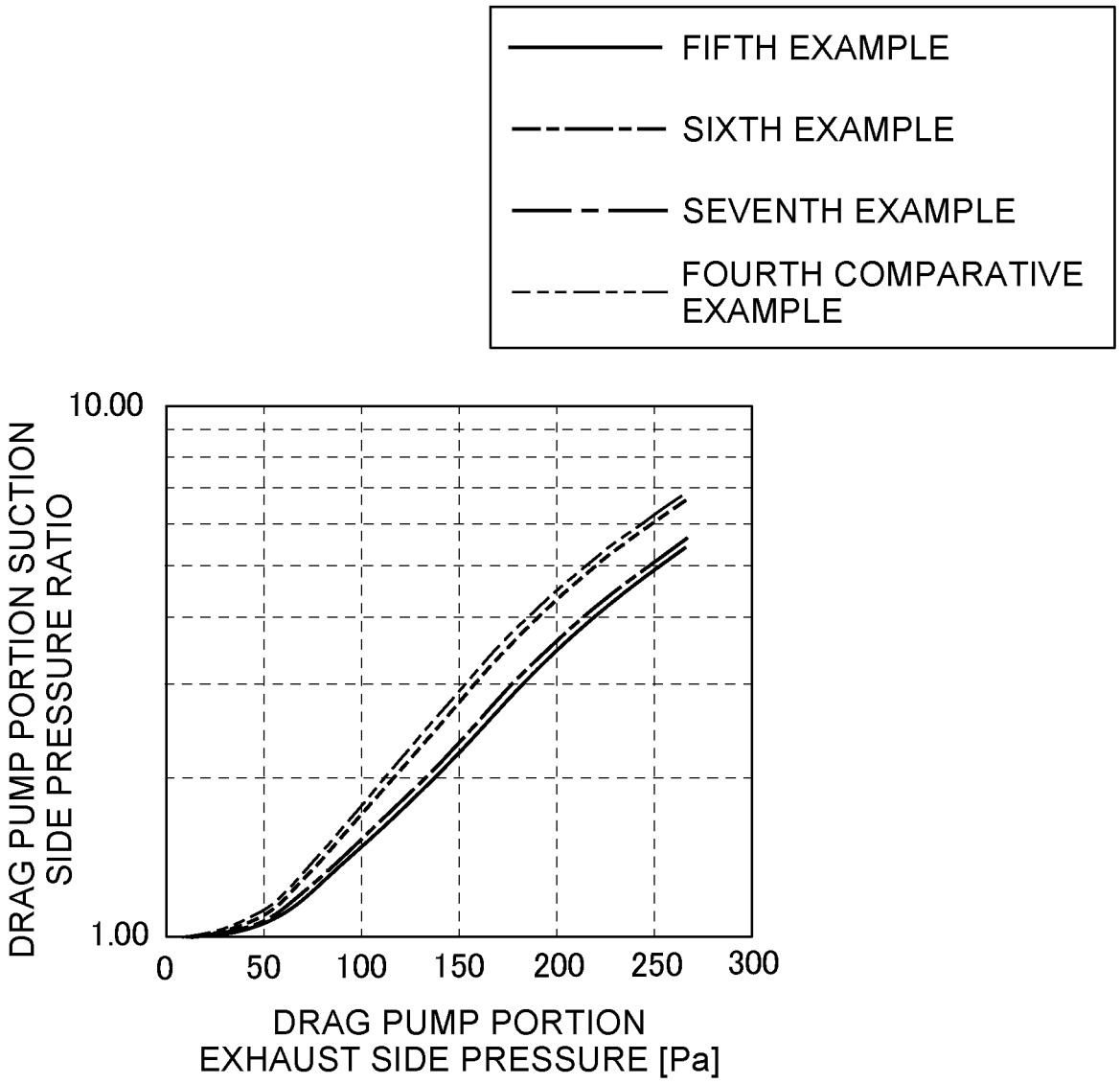
FIG. 18 is a graph showing a change in a suction side pressure in association with the exhaust side pressure of a drag pump portion in fifth to seventh examples and a fourth comparative example.
Figure 19:
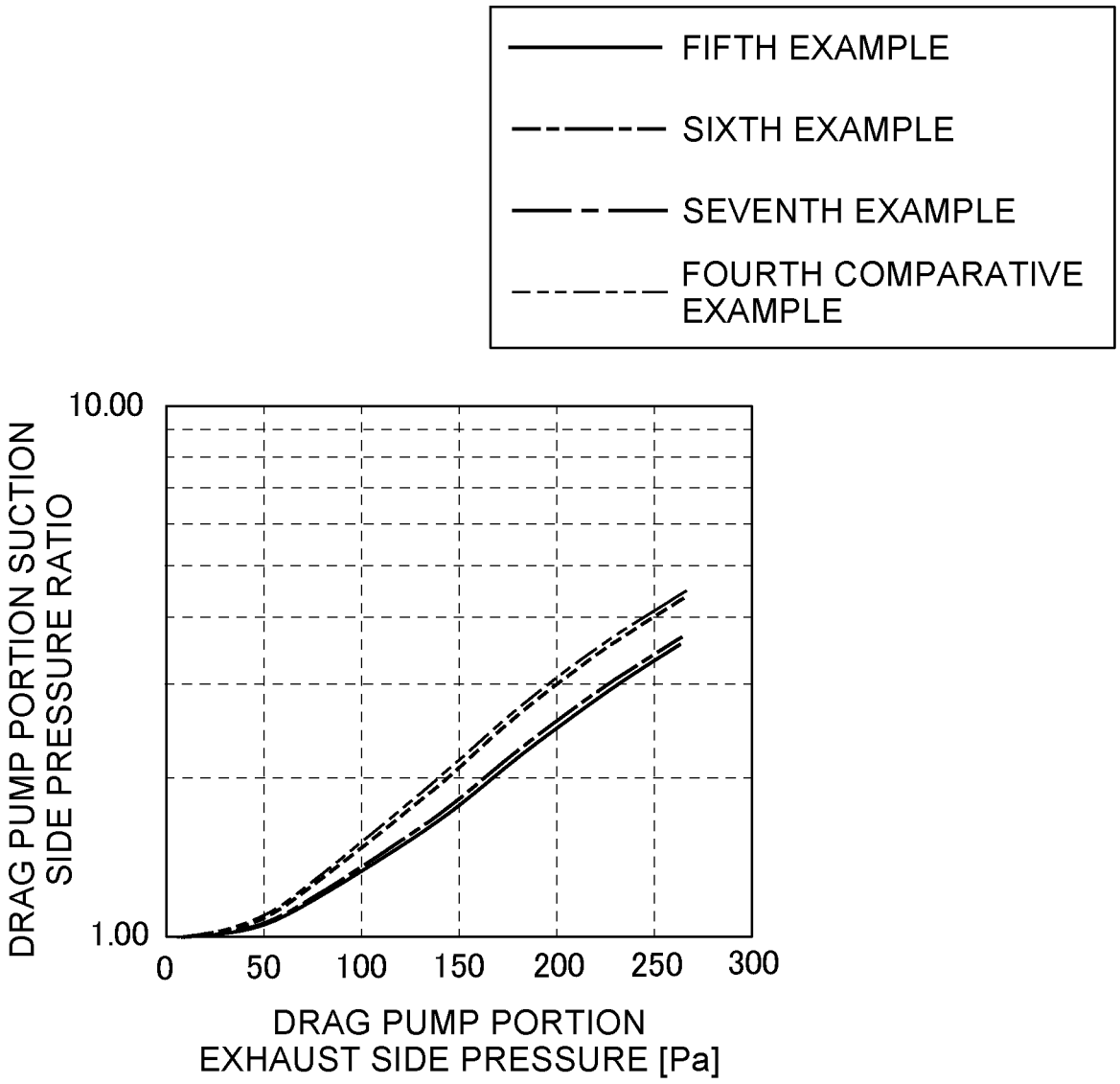
FIG. 19 is a graph showing the change in the suction side pressure in association with the exhaust side pressure of the drag pump portion in the fifth to seventh examples and the fourth comparative example.

Each element of the drag pump portion P2 is set to a value shown in (Table 4) and (Table 5), and performance calculation results are shown in FIGS. 18 and 19.

FIG. 18 is a graph showing a relationship between a suction side pressure and an exhaust side pressure of the drag pump portion P2 when an $N_2$ of 2000 sccm is pumped in the fifth to seventh examples and the fourth comparative example. FIG. 19 is a graph showing a relationship between the suction side pressure and the exhaust side pressure of the drag pump portion P2 when an $N_2$ of 3000 sccm is pumped in the fifth to seventh examples and the fourth comparative example. In FIGS. 18 and 19, the horizontal axis indicates the exhaust side pressure, and the vertical axis indicates a suction side pressure ratio. The suction side pressure ratio is a ratio with reference to the suction side pressure of the drag pump portion P2 when the exhaust side pressure of the drag pump portion P2 is 10 Pa. In FIGS. 18 and 19, the fifth example is indicated by a solid line, the sixth example is indicated by a dotted line, the seventh example is indicated by a chain line, and the fourth comparative example is indicated by a chain double-dashed line.

As shown in FIGS. 18 and 19, even in the case of pumping a great amount such as 2000 sccm or 3000 sccm, an increase in the suction side pressure due to an increase in the exhaust side pressure is suppressed in the fifth to seventh examples as compared to the fourth comparative example. Thus, it shows that in the fifth to seventh examples, back pressure properties are improved as compared to the fourth comparative example. This shows that a portion with the greatest decrement of the groove depth is preferably arranged on the suction side with respect to a portion with the smallest decrement of the groove depth.

Comparison between the fifth example and the seventh example also shows that the portion with the greatest decrement of the groove depth is preferably arranged closest to the suction side because the back pressure properties are further improved. Comparison between the fifth example and the sixth example also shows that the portion with the smallest decrement of the groove depth is preferably arranged closest to the exhaust side because the back pressure properties are further improved.

Eighth to Fifteenth Examples

In the eighth to fifteenth examples below, each element of a drag pump portion P2 is set to a value shown in (Table 6).

TABLE 6

| Element | | Numerical Value |
|---|---|---|
| Screw Angle | Suction Side a | 30° |
| | Exhaust Side b | 15° |
| Groove Depth | Suction Side Da | 12 mm |
| | Exhaust Side Db | 4 mm |
| Screw Thread Diameter | | 200 mm |
| Number of Screw Threads | | 8 |
| Groove Width Ratio | | 0.9 |
| Stator Cylindrical Portion Height Lb | | 100 mm |
| Radius Clearance between Rotor Cylindrical Portion and Stator Cylindrical Portion | | 0.4 mm |

As shown in FIG. 17, a length Lc from an end 6*a* of a stator cylindrical portion 6 on a suction side to a first change portion 175 is set to 25 mm, a length Ld from the end 6*a* to a second change portion 176 is set to 50 mm, and a length Le from the end 6*a* to a third change portion 177 is set to 75 mm.

The stator cylindrical portion in the eighth example is in a shape shown in FIG. 17, and is one example in a case where Decrement E1 of First Decreasing Portion 171≥Decrement E2 of Second Decreasing Portion 172≥Decrement E3 of Third Decreasing Portion 173≥Decrement E4 of Fourth Decreasing Portion 174 is set.

The stator cylindrical portion in the ninth example is one example in a case where Decrement E1 of First Decreasing Portion 171≥Decrement E2 of Second Decreasing Portion 172≥Decrement E4 of Fourth Decreasing Portion 174≥Decrement E3 of Third Decreasing Portion 173 is set.

The stator cylindrical portion in the tenth example is one example in a case where Decrement E1 of First Decreasing Portion 171≥Decrement E3 of Third Decreasing Portion 173≥Decrement E2 of Second Decreasing Portion 172≥Decrement E4 of Fourth Decreasing Portion 174 is set.

The stator cylindrical portion in the eleventh example is one example in a case where Decrement E2 of Second Decreasing Portion 172≥Decrement E1 of First Decreasing Portion 171≥Decrement E3 of Third Decreasing Portion 173≥Decrement E4 of Fourth Decreasing Portion 174 is set.

The stator cylindrical portion in the twelfth example is one example in a case where Decrement E2 of Second Decreasing Portion 172≥Decrement E1 of First Decreasing Portion 171≥Decrement E4 of Fourth Decreasing Portion 174≥Decrement E3 of Third Decreasing Portion 173 is set.

The stator cylindrical portion in the thirteenth example is one example in a case where Decrement E3 of Third Decreasing Portion 173≥Decrement E1 of First Decreasing Portion 171≥Decrement E2 of Second Decreasing Portion 172≥Decrement E4 of Fourth Decreasing Portion 174 is set.

The stator cylindrical portion in the fourteenth example is one example in a case where Decrement E2 of Second Decreasing Portion 172≥Decrement E3 of Third Decreasing Portion 173≥Decrement E1 of First Decreasing Portion 171≥Decrement E4 of Fourth Decreasing Portion 174 is set.

The stator cylindrical portion in the fifteenth example is one example in a case where Decrement E3 of Third Decreasing Portion 173≥Decrement E2 of Second Decreasing Portion 172≥Decrement E1 of First Decreasing Portion 171≥Decrement E4 of Fourth Decreasing Portion 174 is set.

The stator cylindrical portion in the fifth comparative example is in the above-described shape of FIG. 7, and a groove depth D decreases from the end 6*a* toward an end 6*b* at a constant rate and changes linearly.

TABLE 7

| | Fifth Comparative Example | Eighth Example | Ninth Example | Tenth Example |
|---|---|---|---|---|
| Suction Side Groove Depth Da | 12 mm | 12 mm | 12 mm | 12 mm |
| Groove Depth Dd at First Change Portion | Not Set (10 mm) | 9 mm | 9 mm | 9 mm |
| Groove Depth De at Second Change Portion | Not Set (8 mm) | 6.5 mm | 6.5 mm | 7.5 mm |
| Groove Depth Df at Third Change Portion | Not Set (6 mm) | 5 mm | 5.5 mm | 5 mm |
| Exhaust Side Groove Depth Db | 4 mm | 4 mm | 4 mm | 4 mm |
| Decrement E1 of Groove Depth at First Decreasing Portion | 0.08 | 0.12 | 0.12 | 0.12 |
| Decrement E2 of Groove Depth at Second Decreasing Portion | 0.08 | 0.10 | 0.10 | 0.06 |
| Decrement E3 of Groove Depth at Third Decreasing Portion | 0.08 | 0.06 | 0.04 | 0.10 |
| Decrement E4 of Groove Depth at Fourth Decreasing Portion | 0.08 | 0.04 | 0.06 | 0.04 |

Figure 20:
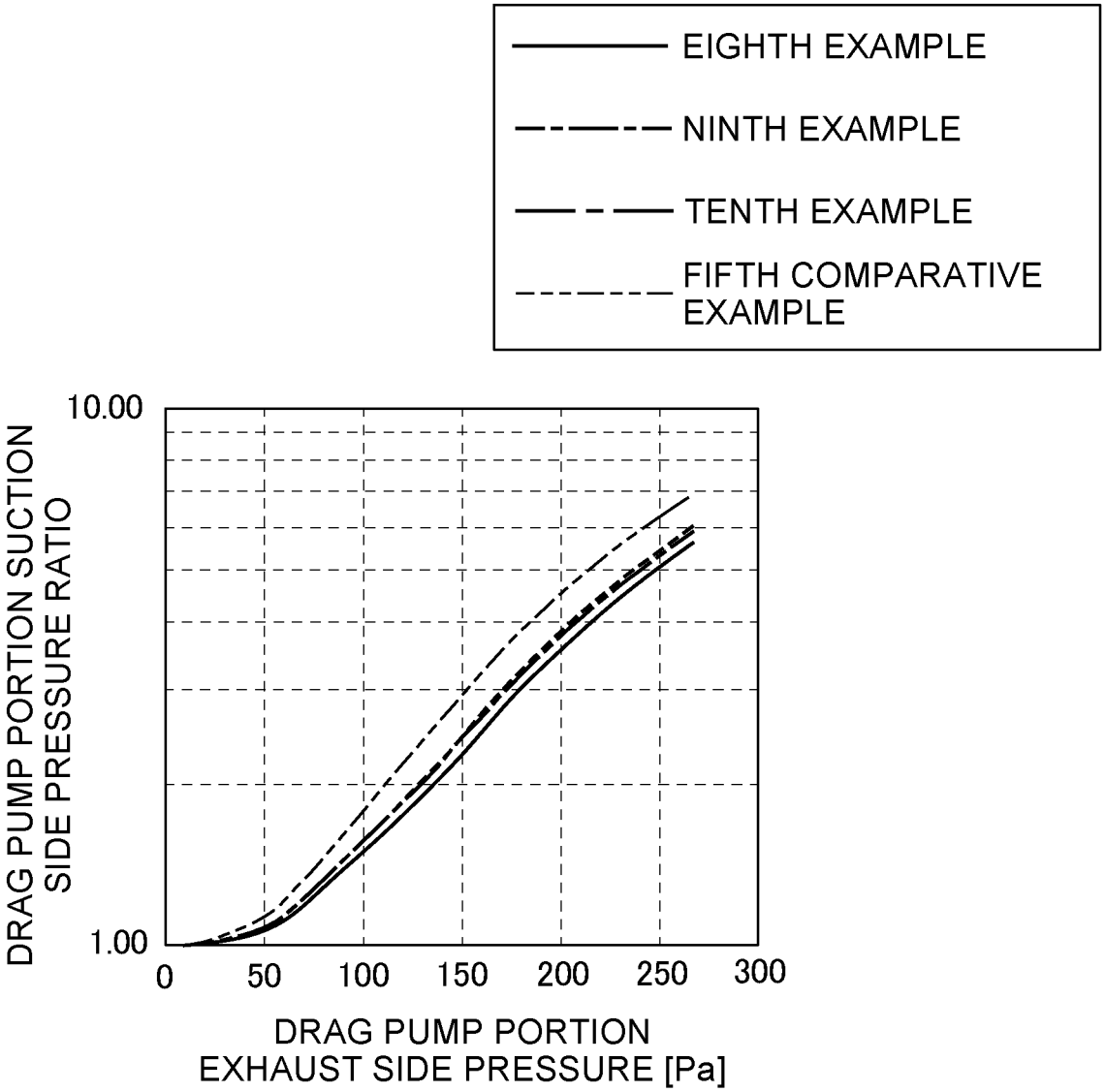
FIG. 20 is a graph showing a change in a suction side pressure in association with the exhaust side pressure of a drag pump portion in eighth to tenth examples and a fifth comparative example.
Figure 21:
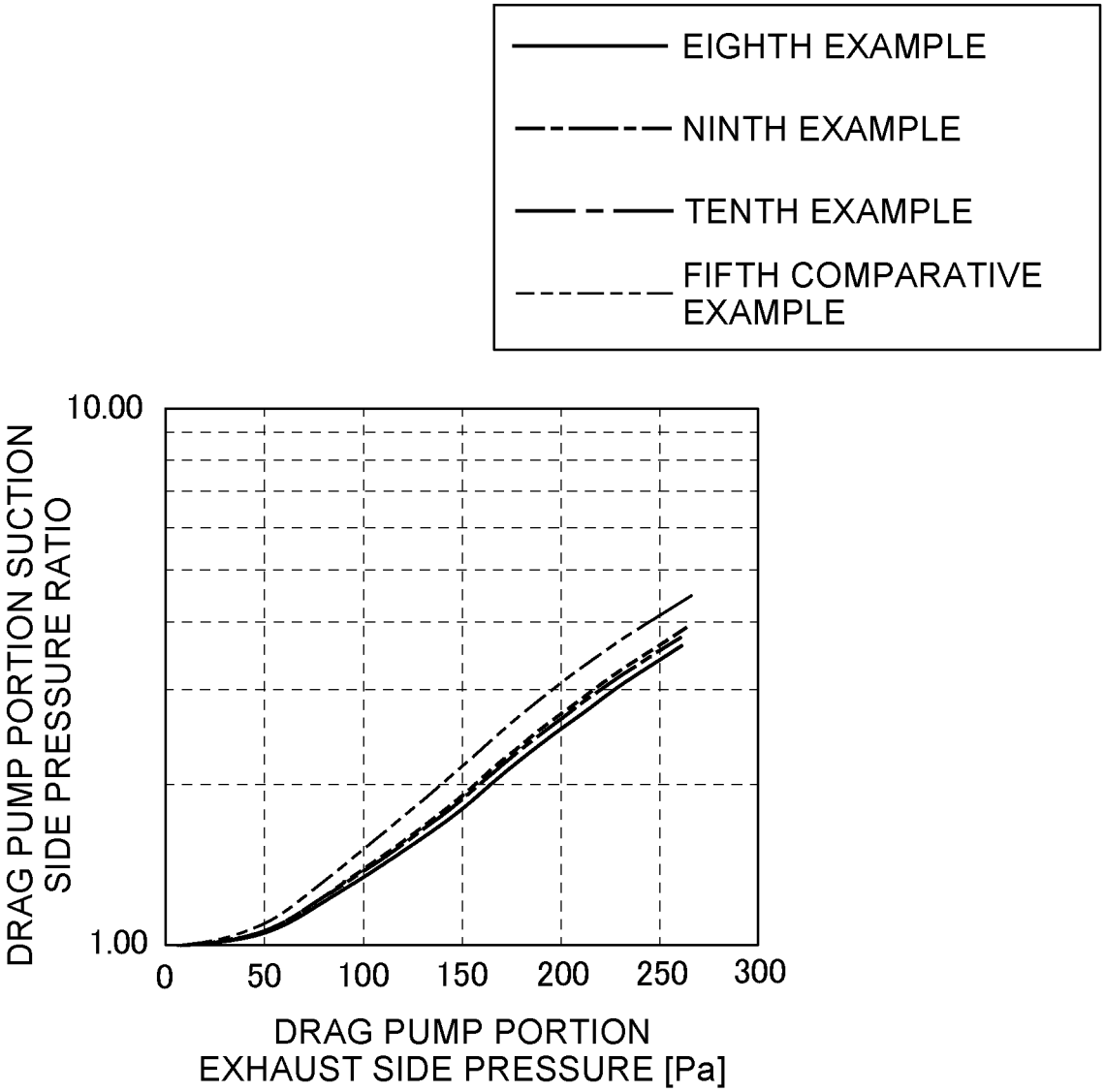
FIG. 21 is a graph showing the change in the suction side pressure in association with the exhaust side pressure of the drag pump portion in the eighth to tenth examples and the fifth comparative example.

Each element of the drag pump portion P2 is set to a value shown in (Table 6) and (Table 7), and performance calculation results are shown in FIGS. 20 and 21.

FIG. 20 is a graph showing a relationship between a suction side pressure and an exhaust side pressure of the drag pump portion P2 when an $N_2$ of 2000 sccm is pumped in the eighth to tenth examples and the fifth comparative example. FIG. 21 is a graph showing a relationship between the suction side pressure and the exhaust side pressure of the drag pump portion P2 when an $N_2$ of 3000 sccm is pumped in the eighth to tenth examples and the fifth comparative example. In FIGS. 20 and 21, the horizontal axis indicates the exhaust side pressure, and the vertical axis indicates a suction side pressure ratio. The suction side pressure ratio is a ratio with reference to the suction side pressure of the drag pump portion P2 when the exhaust side pressure of the drag pump portion P2 is 10 Pa. In FIGS. 20 and 21, the eighth example is indicated by a solid line, the ninth example is indicated by a dotted line, the tenth example is indicated by a chain line, and the fifth comparative example is indicated by a chain double-dashed line.

TABLE 8

| | Fifth Comparative Example | Eleventh Example | Twelfth Example |
|---|---|---|---|
| Suction Side Groove Depth Da | 12 mm | 12 mm | 12 mm |
| Groove Depth Dd at First Change Portion | Not Set (10 mm) | 9.5 mm | 9.5 mm |
| Groove Depth De at Second Change Portion | Not Set (8 mm) | 6.5 mm | 6.5 mm |
| Groove Depth Df at Third Change Portion | Not Set (6 mm) | 5 mm | 5.5 mm |
| Exhaust Side Groove Depth Db | 4 mm | 4 mm | 4 mm |
| Decrement E1 of Groove Depth at First Decreasing Portion | 0.08 | 0.10 | 0.10 |
| Decrement E2 of Groove Depth at Second Decreasing Portion | 0.08 | 0.12 | 0.12 |
| Decrement E3 of Groove Depth at Third Decreasing Portion | 0.08 | 0.06 | 0.04 |
| Decrement E4 of Groove Depth at Fourth Decreasing Portion | 0.08 | 0.04 | 0.06 |

Figure 22:
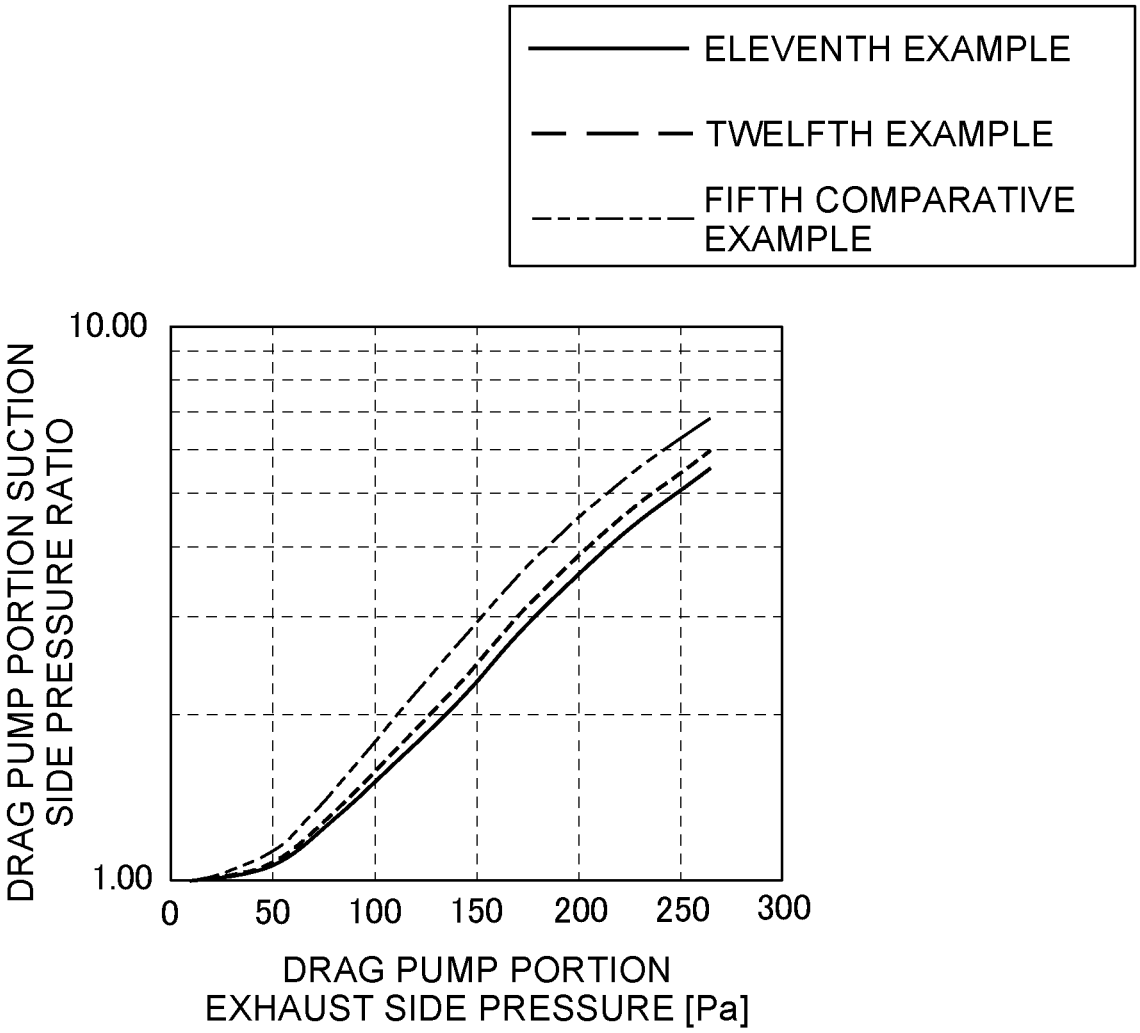
FIG. 22 is a graph showing a change in a suction side pressure in association with the exhaust side pressure of a drag pump portion in eleventh and twelfth examples and the fifth comparative example.
Figure 23:
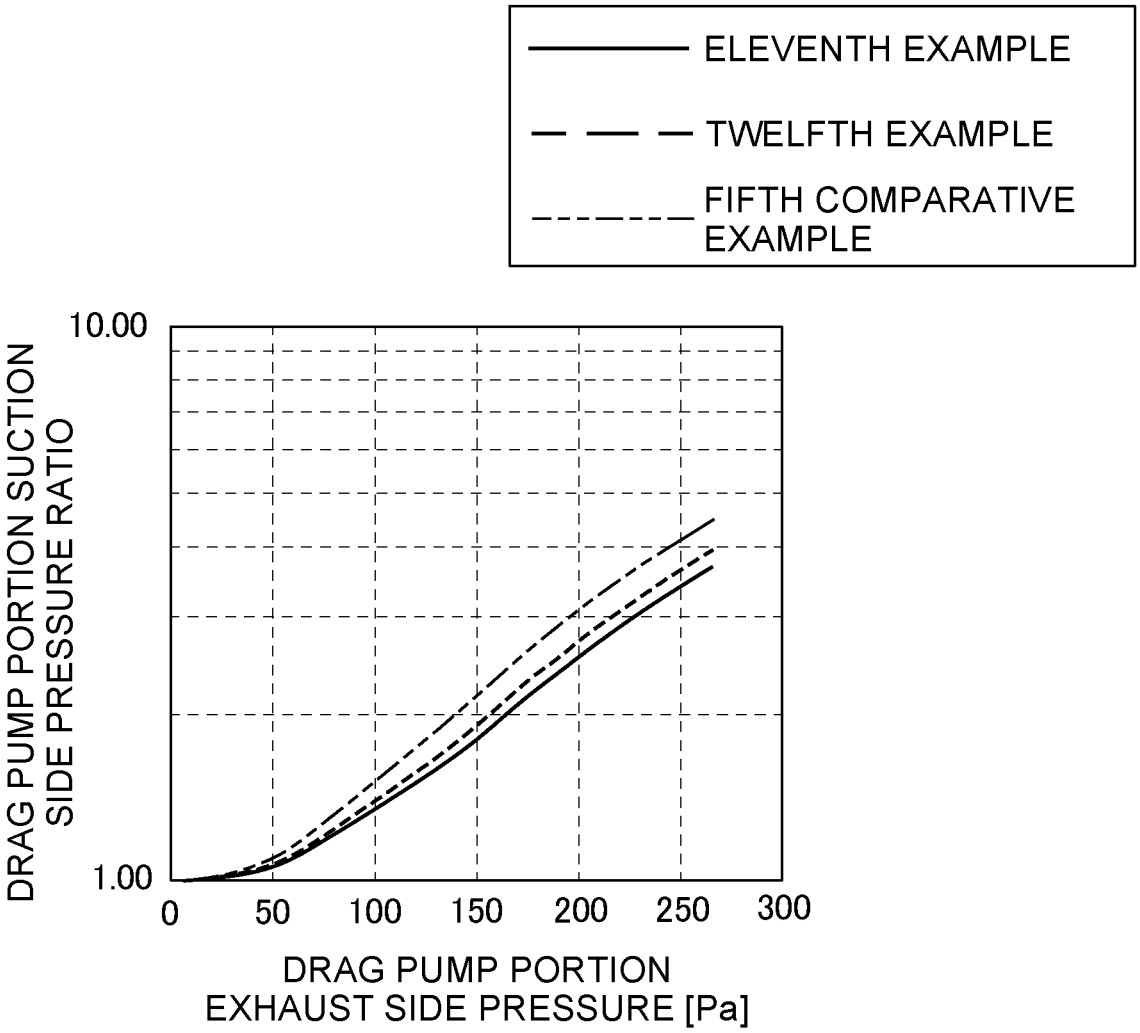
FIG. 23 is a graph showing the change in the suction side pressure in association with the exhaust side pressure of the drag pump portion in the eleventh and twelfth examples and the fifth comparative example.

Each element of the drag pump portion P2 is set to a value shown in (Table 6) and (Table 8), and performance calculation results are shown in FIGS. 22 and 23.

FIG. 22 is a graph showing a relationship between the suction side pressure and the exhaust side pressure of the drag pump portion P2 when an $N_2$ of 2000 sccm is pumped in the eleventh and twelfth examples and the fifth comparative example. FIG. 23 is a graph showing a relationship between the suction side pressure and the exhaust side pressure of the drag pump portion P2 when an $N_2$ of 3000 sccm is pumped in the eleventh and twelfth examples and the fifth comparative example. In FIGS. 22 and 23, the horizontal axis indicates the exhaust side pressure, and the vertical axis indicates a suction side pressure ratio. The suction side pressure ratio is a ratio with reference to the suction side pressure of the drag pump portion P2 when the exhaust side pressure of the drag pump portion P2 is 10 Pa. In FIGS. 22 and 23, the eleventh example is indicated by a solid line, the twelfth example is indicated by a dotted line, and the fifth comparative example is indicated by a chain double-dashed line.

TABLE 9

| | Fifth Comparative Example | Thirteenth Example | Fourteenth Example | Fifteenth Example |
|---|---|---|---|---|
| Suction Side Groove Depth Da | 12 mm | 12 mm | 12 mm | 12 mm |
| Groove Depth Dd at First Change Portion | Not Set (10 mm) | 9.5 mm | 10.5 mm | 10.5 mm |
| Groove Depth De at Second Change Portion | Not Set (8 mm) | 8 mm | 7.5 mm | 8 mm |
| Groove Depth Df at Third Change Portion | Not Set (6 mm) | 5 mm | 5 mm | 5 mm |
| Exhaust Side Groove Depth Db | 4 mm | 4 mm | 4 mm | 4 mm |
| Decrement E1 of Groove Depth at First Decreasing Portion | 0.08 | 0.10 | 0.06 | 0.06 |
| Decrement E2 of Groove Depth at Second Decreasing Portion | 0.08 | 0.06 | 0.12 | 0.10 |
| Decrement E3 of Groove Depth at Third Decreasing Portion | 0.08 | 0.12 | 0.10 | 0.12 |
| Decrement E4 of Groove Depth at Fourth Decreasing Portion | 0.08 | 0.04 | 0.04 | 0.04 |

Figure 24:
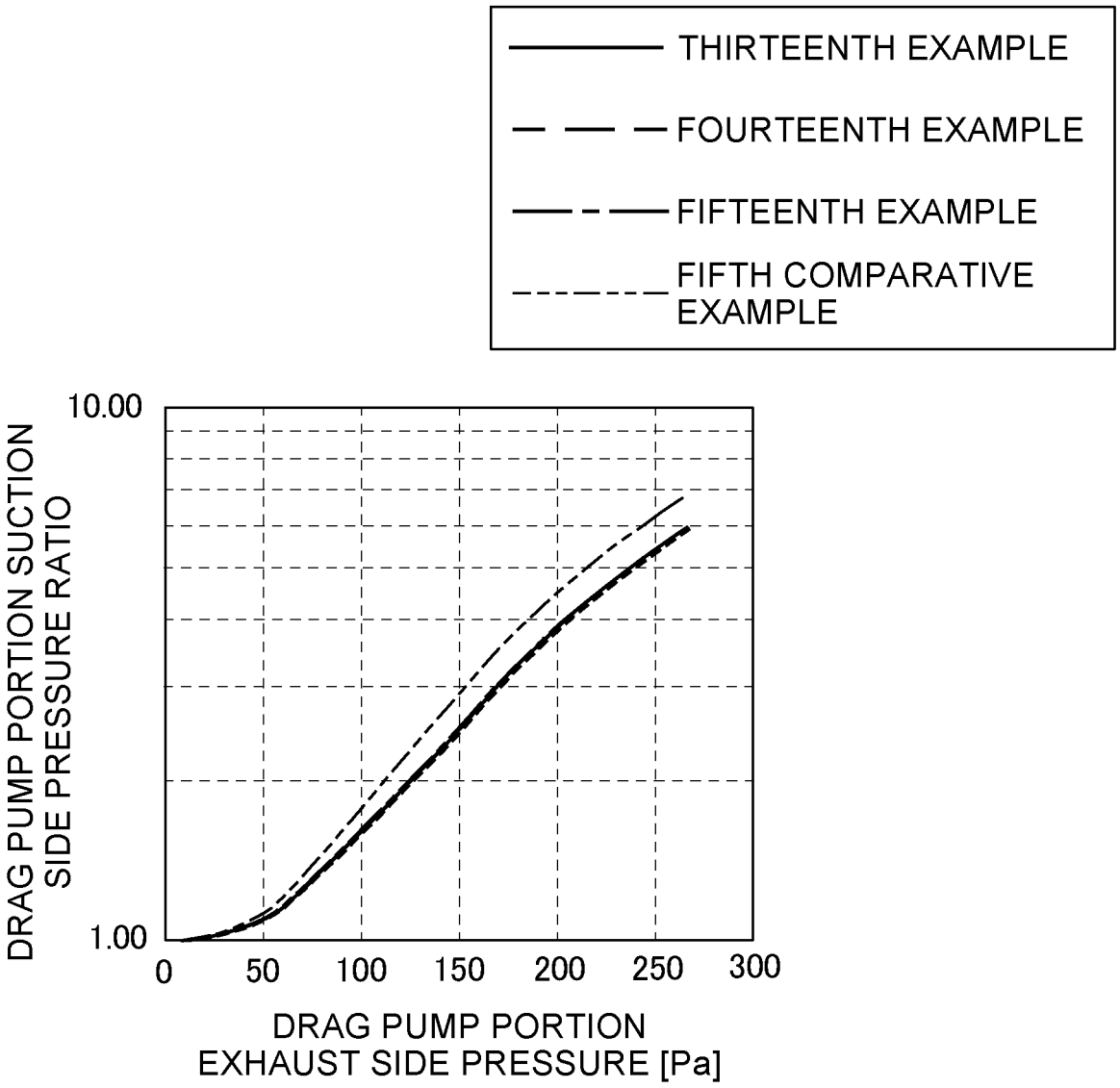
FIG. 24 is a graph showing a change in a suction side pressure in association with the exhaust side pressure of a drag pump portion in thirteenth to fifteenth examples and the fifth comparative example.
Figure 25:
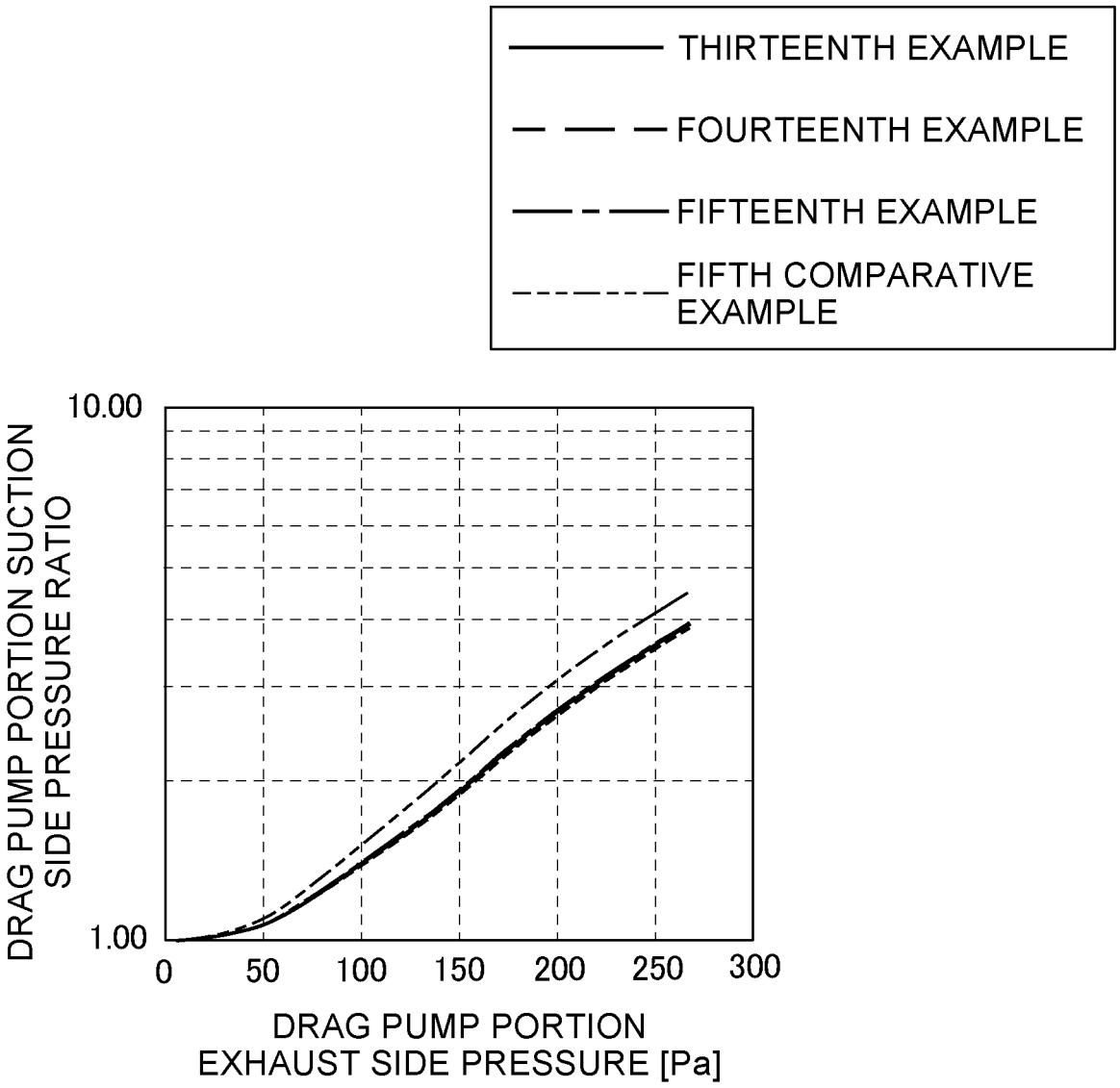
FIG. 25 is a graph showing the change in the suction side pressure in association with the exhaust side pressure of the drag pump portion in the thirteenth to fifteenth examples and the fifth comparative example.

Each element of the drag pump portion P2 is set to a value shown in (Table 6) and (Table 9), and performance calculation results are shown in FIGS. 24 and 25.

FIG. 24 is a graph showing a relationship between the suction side pressure and the exhaust side pressure of the drag pump portion P2 when an $N_2$ of 2000 sccm is pumped in the thirteenth to fifteenth examples and the fifth comparative example. FIG. 25 is a graph showing a relationship between the suction side pressure and the exhaust side pressure of the drag pump portion P2 when an $N_2$ of 3000 sccm is pumped in the thirteenth to fifteenth examples and the fifth comparative example. In FIGS. 24 and 25, the horizontal axis indicates the exhaust side pressure, and the vertical axis indicates a suction side pressure ratio. The suction side pressure ratio is a ratio with reference to the suction side pressure of the drag pump portion P2 when the exhaust side pressure of the drag pump portion P2 is 10 Pa. In FIGS. 24 and 25, the thirteenth example is indicated by a solid line, the fourteenth example is indicated by a dotted line, the fifteenth example is indicated by a chain line, and the fifth comparative example is indicated by a chain double-dashed line.

As shown in FIGS. 20 to 25, even in the case of pumping a great amount such as 2000 sccm or 3000 sccm, an increase in the suction side pressure due to an increase in the exhaust side pressure is suppressed in the eighth to fifteenth examples as compared to the fifth comparative example. Thus, it shows that in the eighth to fifteenth examples, back pressure properties are improved as compared to the fifth comparative example. This shows that a portion with the greatest decrement of the groove depth is preferably arranged on the suction side with respect to a portion with the smallest decrement of the groove depth.

For example, comparison of the eighth example with the thirteenth and fourteenth examples shows that the portion with the greatest decrement of the groove depth is preferably arranged closest to the suction side. For example, comparison between the eighth example and the ninth example shows that the portion with the smallest decrement of the groove depth is preferably arranged closest to the exhaust side because the back pressure properties are further improved.

OTHER EMBODIMENTS

The embodiments of the present invention have been described above, but the present invention is not limited to the above-described embodiments and various changes can be made without departing from the gist of the invention.

In the above-described embodiments, the decrements are constant at the suction side portion 71 and the exhaust side portion 72, and therefore, the tip end 62*a* is linearly formed. However, the tip end 62*a* may be curved through the change portion 73. In other words, the decrement is not necessarily constant as long as the decrement at the suction side portion 71 is greater than the decrement at the exhaust side portion 72.

In the above-described embodiments, the screw groove is formed on the inner peripheral surface 6*s* of the stator cylindrical portion 6, but may be formed on an outer peripheral surface of the rotor cylindrical portion 23. Moreover, the stator cylindrical portion 6 may be integrated with the base 9.

In the above-described embodiments, the five to eight screw threads 62 are formed as examples, but the number of screw threads 62 may be 5 or less or 8 or more.

Figure 26:
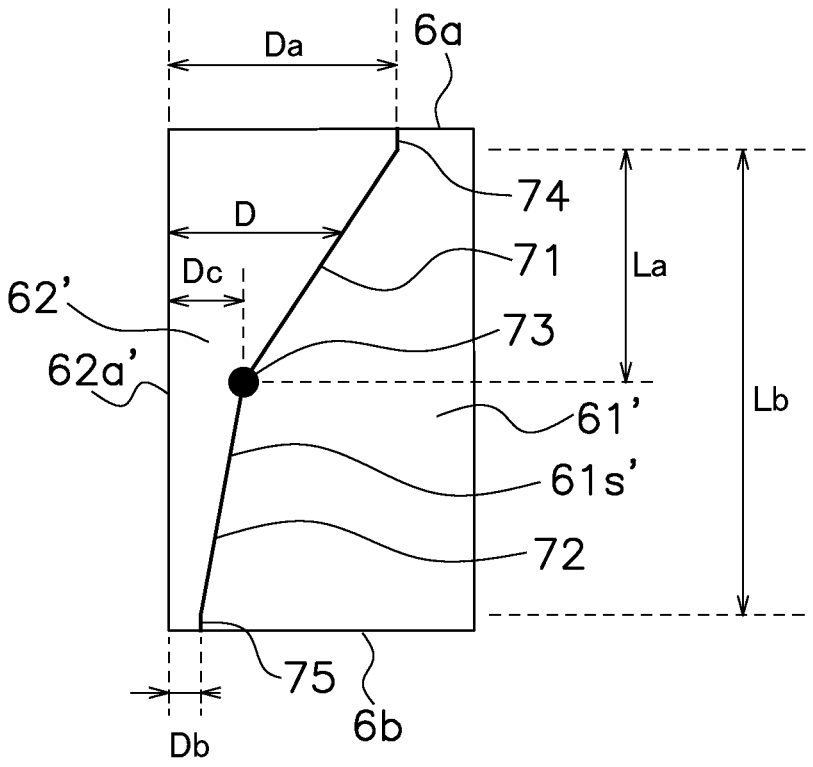
FIG. 26 is a view showing a change in a screw groove depth in a variation of the embodiments.

In the above-described embodiments, the end of the suction side portion 71 as one example of the first portion on the suction side is coincident with the end 6*a*, and the end of the exhaust side portion 72 on the exhaust side is coincident with the end 6*b*. However, portions of the cylindrical portion main body and the screw thread may be further provided on the suction side of the suction side portion 71. Moreover, portions of the cylindrical portion main body and the screw thread may be further provided on the exhaust side of the exhaust side portion 72. FIG. 26 is a view showing a change in a groove depth D from a tip end 62*a*' of a screw thread 62' to an inner peripheral surface 61*s*' of a cylindrical portion main body 61' in a variation. At the inner peripheral surface 61*s*' of the cylindrical portion main body 61', an end portion 74 is provided between the suction side portion 71 and the end 6*a*, and an end portion 75 is provided between the exhaust side portion 72 and the end 6*b*. In the variation shown in FIG. 26, the groove depth D at the end portion 74 is constant and is the same as the groove depth Da at the end of the suction side portion 71 on the suction port 14 side. Moreover, in the variation shown in FIG. 26, the groove depth D at the end portion 75 is constant and is the same as the groove depth Db at the end of the exhaust side portion 72 on the exhaust port 16 side. Note that the end portions 74, 75 may be formed such that the groove depths D thereof decrease from the end 6*a* toward the end 6*b*.

(Aspects)

Those skilled in the art understand that the above-described multiple exemplary embodiments are specific examples of the following aspects.

(First Aspect)

A vacuum pump includes a housing, a rotor cylindrical portion, and a stator cylindrical portion. The housing has an inlet port for sucking gas and an outlet port for discharging the sucked gas. The rotor cylindrical portion is housed in the housing. The stator cylindrical portion is housed in the housing, and is arranged to face the rotor cylindrical portion. A screw groove is formed on one of opposing surfaces of the stator cylindrical portion and the rotor cylindrical portion. The groove depth of the screw groove is smaller at an end on an exhaust side than at an end on a suction side. The decrement of the groove depth is greater on the suction side than on the exhaust side.

In the vacuum pump according to the first aspect, the groove depth of the screw groove is set smaller at the end on the exhaust side than at the end on the suction side, and the decrement of the groove depth is set greater on the suction side than on the exhaust side. Since the decrement of the groove depth is greater on the suction side as described above, gas molecules are easily sent from the suction side to the exhaust side in the screw groove. Moreover, since the decrement of the groove depth is smaller on the exhaust side, a backflow of gas molecules from the exhaust side to the suction side in the screw groove can be prevented.

Thus, even in a case where a great conductance of a drag pump portion formed by the rotor cylindrical portion and the stator cylindrical portion is set, back pressure properties can be improved.

Since the back pressure properties are improved, an increase in a suction side pressure can be suppressed even with a greater exhaust side pressure. Thus, a small auxiliary pump leading to an increase in the outlet port side pressure can be selected. Consequently, the degree of freedom in design can be enhanced, a cost can be reduced, and maintenance can be improved.

(Second Aspect)

In the vacuum pump according to the first aspect, the screw groove has a first portion and a second portion. The decrement of the groove depth at the first portion is constant. The second portion is arranged on the exhaust side with respect to the first portion, and the decrement of the groove depth at the second portion is constant. The decrement at the first portion is greater than the decrement at the second portion.

In the vacuum pump according to the second aspect, gas molecules are easily sent to the exhaust side at the first portion, and are less likely to flow back at the second portion. Thus, even in a case where a great conductance of the drag pump portion formed by the rotor cylindrical portion and the stator cylindrical portion is set, the back pressure properties can be improved.

(Third Aspect)

In the vacuum pump according to the second aspect, the first portion and the second portion are connected to each other at a change portion. When the groove depth at an end of the first portion on the suction side is Da, the groove depth at an end of the second portion on the exhaust side is Db, and the groove depth at the change portion is Dc, $Db \leq Dc \leq (Da+Db) \times 0.5$ is satisfied.

In the vacuum pump according to the third aspect, since $Db \leq Dc \leq (Da+Db) \times 0.5$ is satisfied, the back pressure properties can be improved even in a case where a great conductance of the drag pump portion is set.

(Fourth Aspect)

In the vacuum pump according to the third aspect, when a length from the end of the first portion on the suction side to the change portion along an axial direction of the rotor cylindrical portion is La and a length from the end of the first portion on the suction side to the end of the second portion on the exhaust side along the axial direction is Lb, $0 < La < Lb \times 2/3$ is satisfied.

In the vacuum pump according to the fourth aspect, since $0 < La < Lb \times 2/3$ is satisfied, the back pressure properties can be improved even in a case where a great conductance of the drag pump portion is set.

(Fifth Aspect)

In the vacuum pump according to the third or fourth aspect, 1.5 Da/Db is further satisfied.

In the vacuum pump according to the fifth aspect, since 1.5 Da/Db is satisfied, the back pressure properties can be improved even in a case where a great conductance of the drag pump portion is set.

(Sixth Aspect)

In the vacuum pump according to the first aspect, the screw groove has multiple portions of which decrements of the groove depth are different from each other. A portion with the greatest decrement of the groove depth is arranged on the suction side with respect to a portion with the smallest decrement of the groove depth.

In the vacuum pump according to the sixth aspect, since the portion with the greatest decrement of the groove depth is arranged on the suction side with respect to the portion with the smallest decrement of the groove depth, gas molecules can be easily sent from the suction side to the exhaust side in the screw groove, and a backflow of gas molecules from the exhaust side to the suction side in the screw groove can be prevented.

Thus, even in a case where a great conductance of the drag pump portion is set, the back pressure properties can be improved.

(Seventh Aspect)

In the vacuum pump according to the sixth aspect, among the multiple portions, the portion with the greatest decrement of the groove depth is arranged closest to the suction side.

In the vacuum pump according to the seventh aspect, gas molecules can be more easily sent from the suction side to the exhaust side in the screw groove.

(Eighth Aspect)

In the vacuum pump according to the sixth or seventh aspect, among the multiple portions, the portion with the smallest decrement of the groove depth is arranged closest to the exhaust side.

In the vacuum pump according to the eighth aspect, a backflow of gas molecules from the exhaust side to the suction side in the screw groove can be further prevented.

The invention claimed is:

1. A vacuum pump comprising:

a housing having an inlet port for sucking gas and an outlet port for discharging the sucked gas;

a rotor cylindrical portion housed in the housing; and a stator cylindrical portion housed in the housing and arranged to face the rotor cylindrical portion, wherein a screw groove is formed on one of opposing surfaces of the stator cylindrical portion and the rotor cylindrical portion, a groove depth of the screw groove is smaller at an end on an exhaust side than at an end on a suction side, and a decrement of the groove depth is greater on the suction side than on the exhaust side, the screw groove has a first portion of which decrement of the groove depth is constant, and a second portion which is arranged on the exhaust side with respect to the first portion and of which decrement of the groove depth is constant, the decrement at the first portion is greater than the decrement at the second portion, the first portion and the second portion are connected to each other at a decrement change portion, and when the groove depth at an end of the first portion on the suction side is Da, the groove depth at an end of the second portion on the exhaust side is Db, and the groove depth at the change portion is Dc, $Db \leq Dc \leq (Da+Db) \times 0.5$ is satisfied.

2. The vacuum pump according to claim 1, wherein when a length from the end of the first portion on the suction side to the change portion along an axial direction of the rotor cylindrical portion is La, and a length from the end of the first portion on the suction side to the end of the second portion on the exhaust side along the axial direction is Lb, $0 < La < Lb \times 2/3$ is satisfied.

3. The vacuum pump according to claim 1, wherein $1.5 \leq Da/Db$ is further satisfied.

4. The vacuum pump according to claim 1, wherein the screw groove has multiple portions of which decrements of the groove depth are different from each other, and a portion with a greatest decrement of the groove depth is arranged on the suction side with respect to a portion with a smallest decrement of the groove depth.

5. The vacuum pump according to claim 4, wherein among the multiple portions, the portion with the greatest decrement of the groove depth is arranged closest to the suction side.

6. The vacuum pump according to claim 4, wherein among the multiple portions, the portion with the smallest decrement of the groove depth is arranged closest to the exhaust side.

7. A vacuum pump comprising:

a housing having an inlet port for sucking gas and an outlet port for discharging the sucked gas;

a rotor cylindrical portion housed in the housing; and a stator cylindrical portion housed in the housing and arranged to face the rotor cylindrical portion, wherein a screw groove is formed on one of opposing surfaces of the stator cylindrical portion and the rotor cylindrical portion, a groove depth of the screw groove is smaller at an end on an exhaust side than at an end on a suction side, a decrement of the groove depth is greater on the suction side than on the exhaust side, the screw groove has a first portion of which decrement of the groove depth is constant, a second portion which is arranged on the exhaust side with respect to the first portion and of which decrement of the groove depth is constant, and a third portion of which decrement of the groove depth is constant, the third portion being arranged between the first portion and the second portion, the decrement at the first portion is greater than the decrement at the second portion, the decrement at the third portion is different from the decrement at the first portion and the decrement at the second portion, and the decrement at the third portion is smaller than the decrement at the second portion.

8. A vacuum pump comprising:

a housing having an inlet port for sucking gas and an outlet port for discharging the sucked gas;

a rotor cylindrical portion housed in the housing; and a stator cylindrical portion housed in the housing and arranged to face the rotor cylindrical portion, wherein a screw groove is formed on one of opposing surfaces of the stator cylindrical portion and the rotor cylindrical portion, a groove depth of the screw groove is smaller at an end on an exhaust side than at an end on a suction side, a decrement of the groove depth is greater on the suction side than on the exhaust side, the screw groove has a first portion of which decrement of the groove depth is constant, a second portion which is arranged on the exhaust side with respect to the first portion and of which decrement of the groove depth is constant, and a third portion of which decrement of the groove depth is constant, the third portion being arranged between the first portion and the second portion, the decrement at the first portion is greater than the decrement at the second portion, the decrement at the third portion is different from the decrement at the first portion and the decrement at the second portion, and the decrement at the third portion is greater than the decrement at the first portion.

* * * * *